US007228797B1

(12) United States Patent
Hillman et al.

(10) Patent No.: US 7,228,797 B1
(45) Date of Patent: Jun. 12, 2007

(54) CORDLESS BLIND

(75) Inventors: Michael D. Hillman, Campbell, CA (US); Evan T. Ward, Chicago, IL (US); Paul B. Specht, Wilmette, IL (US)

(73) Assignee: Sundberg-Ferar, Inc., Chicago, IL (US)

( * ) Notice: Subject to any disclaimer, the term of this patent is extended or adjusted under 35 U.S.C. 154(b) by 888 days.

(21) Appl. No.: 09/724,279

(22) Filed: Nov. 28, 2000

(51) Int. Cl.
*E06B 9/322* (2006.01)

(52) U.S. Cl. ..... 100/170; 242/375.1

(58) Field of Classification Search ..... 160/170 R, 160/171 R, 191, 192; 242/373, 375.1, 377, 242/378.1, 397.5
See application file for complete search history.

(56) References Cited

U.S. PATENT DOCUMENTS

| | | | | |
|---|---|---|---|---|
| 13,251 | A | 7/1855 | Bixler | |
| 322,732 | A | 7/1885 | Lang | |
| 350,429 | A * | 10/1886 | Griswold | |
| 842,401 | A | 1/1907 | Goodell | |
| 927,090 | A | 7/1909 | Anderson | |
| 948,239 | A | 2/1910 | McManus | |
| 1,636,601 | A | 7/1927 | Givens | |
| 1,669,255 | A | 5/1928 | Landry | |
| 1,721,501 | A | 7/1929 | McKee | |
| 1,731,124 | A | 10/1929 | Carper | |
| 1,789,655 | A | 1/1931 | Toshi-Ko Iwata | |
| 1,863,620 | A * | 6/1932 | Carouso | |
| 1,951,659 | A | 3/1934 | Kesner | 156/17 |
| 2,037,393 | A | 4/1936 | Roberts | 156/17 |
| 2,049,518 | A | 8/1936 | Schier | 156/16 |

(Continued)

FOREIGN PATENT DOCUMENTS

| | | |
|---|---|---|
| DE | 40 03 218 A1 | 8/1991 |

(Continued)

OTHER PUBLICATIONS

U.S. Appl. No. 09/229,111, filed on Jan. 12, 1999 and listing Robert J. Voss, Kelly L. Murphy, and Otto Kuhar as inventors (20 pages).

(Continued)

*Primary Examiner*—Blair M. Johnson
(74) *Attorney, Agent, or Firm*—Marshall, Gerstein & Borun LLP

(57) ABSTRACT

A cordless blind includes a headrail, a bottom rail suspended from the headrail by a first cord and a second cord, a wall covering disposed between the headrail and the bottom rail, and a drive actuator. The drive actuator includes a spring motor, a spool coupled to the spring motor, a first tensioning mechanism, and a second tensioning mechanism. The first and second tensioning mechanisms are configured to impact a resistant force on movement of the first and second cords. The drive actuator may include a spool, a spring motor, a biasing element configured to provide a force biased against movement of the bottom rail, and a bias relief mechanism that is configured to provide for selective application and relief of the biasing force by the biasing element. The drive actuator may include a constant biasing element, a generally rigid strap, a mandrel, a biasing member, and a traction wheel including a plurality of cogs extending from the circumference of the traction wheel such that movement of the strap rotates the traction wheel.

17 Claims, 15 Drawing Sheets

U.S. PATENT DOCUMENTS

| | | | | | |
|---|---|---|---|---|---|
| 2,110,983 | A | | 3/1938 | Carver | 156/16 |
| 2,175,549 | A | | 10/1939 | Nardulli et al. | 156/17 |
| 2,250,106 | A | | 7/1941 | Lorentzen | 156/17 |
| 2,260,101 | A | | 10/1941 | De Falco | 156/16 |
| 2,266,160 | A | | 12/1941 | Burns | 156/17 |
| 2,276,716 | A | | 3/1942 | Cardona | 156/17 |
| 2,324,536 | A | | 7/1943 | Pratt | 160/172 |
| 2,325,992 | A | | 8/1943 | Wirthman | 160/29 |
| 2,350,094 | A | | 5/1944 | Butts | 160/114 |
| 2,390,826 | A | | 12/1945 | Cohn | 160/170 |
| 2,410,549 | A | | 11/1946 | Olson | 160/34 |
| 2,420,301 | A | | 5/1947 | Cusumano | 160/34 |
| 2,509,033 | A | | 5/1950 | Carver | 160/84 |
| 2,520,629 | A | | 8/1950 | Esposito | 160/171 |
| 2,535,751 | A | | 12/1950 | Nardulli | 160/170 |
| 2,598,887 | A | | 6/1952 | Burns | 160/170 |
| 2,609,193 | A | | 9/1952 | Foster | 267/1 |
| 2,687,769 | A | | 8/1954 | Gershuny | 160/170 |
| 2,824,608 | A | | 2/1958 | Etten | 160/170 |
| 2,874,612 | A | | 2/1959 | Luboshez | 88/60 |
| 3,141,497 | A | | 7/1964 | Griesser | 160/170 |
| 3,194,343 | A | | 7/1965 | Sindlinger | 185/10 |
| 3,308,247 | A | * | 3/1967 | Doersam et al. | |
| 3,358,612 | A | | 12/1967 | Bleuer | 104/173 |
| 3,371,700 | A | | 3/1968 | Romano | 160/84 |
| 3,485,285 | A | | 12/1969 | Anderle | 160/168 |
| 3,487,875 | A | | 1/1970 | Shukat et al. | 160/84 |
| 3,756,585 | A | | 9/1973 | Mihalcheon | 267/156 |
| 3,817,309 | A | | 6/1974 | Takazawa | 160/84 |
| 4,055,038 | A | * | 10/1977 | Conklin, Jr. | |
| 4,157,108 | A | | 6/1979 | Donofrio | 160/263 |
| 4,205,816 | A | | 6/1980 | Yu | 248/266 |
| 4,223,714 | A | | 9/1980 | Weinreich et al. | 160/309 |
| 4,326,577 | A | | 4/1982 | Tse | 160/259 |
| 4,344,474 | A | | 8/1982 | Berman | 160/121 R |
| 4,398,585 | A | | 8/1983 | Marlow | 160/23 R |
| 4,487,243 | A | | 12/1984 | Debs | 160/168 R |
| 4,574,864 | A | | 3/1986 | Tse | 160/259 |
| 4,610,292 | A | | 9/1986 | Hausmann et al. | 160/120 |
| 4,623,012 | A | | 11/1986 | Rude et al. | 160/243 |
| 4,625,786 | A | | 12/1986 | Carter et al. | 160/84 R |
| 4,631,217 | A | | 12/1986 | Anderson | 428/118 |
| 4,647,488 | A | | 3/1987 | Schnebly et al. | 428/116 |
| 4,726,410 | A | | 2/1988 | Fresh | 160/84 R |
| 4,852,627 | A | | 8/1989 | Peterson et al. | 160/84.1 |
| 4,856,574 | A | | 8/1989 | Minami et al. | 160/168.1 |
| 4,862,941 | A | | 9/1989 | Colson | 160/84.1 |
| 4,877,075 | A | | 10/1989 | Markowitz | 160/84.1 |
| 4,880,045 | A | | 11/1989 | Stahler | 160/84.1 |
| 4,886,102 | A | | 12/1989 | Debs | 160/177 |
| 4,955,421 | A | | 9/1990 | Torti | 160/243 |
| 4,984,617 | A | | 1/1991 | Corey | 160/84.1 |
| 5,054,162 | A | | 10/1991 | Rogers | 16/198 |
| 5,067,541 | A | | 11/1991 | Coslett | 160/84.1 |
| 5,083,598 | A | | 1/1992 | Schon | 160/84.1 |
| 5,103,888 | A | | 4/1992 | Nakamura | 160/171 |
| 5,105,867 | A | | 4/1992 | Coslett | 160/84.1 |
| 5,133,399 | A | | 7/1992 | Hiller et al. | 160/171 |
| 5,141,041 | A | | 8/1992 | Katz et al. | 160/84.1 |
| 5,157,808 | A | | 10/1992 | Sterner, Jr. | 16/197 |
| 5,170,830 | A | | 12/1992 | Coslett | 160/84.1 |
| 5,176,192 | A | * | 1/1993 | Judkins et al. | |
| 5,184,660 | A | | 2/1993 | Jelic | 160/171 |
| 5,228,491 | A | | 7/1993 | Rude et al. | 160/171 |
| 5,274,357 | A | | 12/1993 | Riordan | 340/550 |
| 5,313,998 | A | | 5/1994 | Colson et al. | 160/84.1 D |
| 5,318,090 | A | | 6/1994 | Chen | 160/171 |
| 5,320,154 | A | | 6/1994 | Colson et al. | 160/121.1 |
| 5,363,898 | A | | 11/1994 | Sprague | 160/98 |
| 5,391,967 | A | | 2/1995 | Domel et al. | 318/254 |
| 5,413,161 | A | | 5/1995 | Corazzini | 160/7 |
| 5,482,100 | A | | 1/1996 | Kuhar | 160/170 |
| 5,485,875 | A | | 1/1996 | Genova | 160/168.1 |
| 5,531,257 | A | | 7/1996 | Kuhar | 160/168.1 |
| 5,706,876 | A | | 1/1998 | Lysyj | 160/84.05 |
| 5,855,235 | A | | 1/1999 | Colson et al. | 160/121.1 |
| 6,003,584 | A | | 12/1999 | Weinreich | 160/191 |
| 6,012,506 | A | | 1/2000 | Wang et al. | 160/170 |
| 6,024,154 | A | | 2/2000 | Wang et al. | 160/170 |
| 6,029,734 | A | | 2/2000 | Wang et al. | 160/170 R |
| 6,056,036 | A | | 5/2000 | Todd et al. | 160/84.05 |
| 6,079,471 | A | | 6/2000 | Kuhar | 160/170 R |
| 6,095,222 | A | | 8/2000 | Voss | 160/84.05 |
| 6,097,471 | A | | 8/2000 | Kuhr et al. | |
| 6,135,189 | A | | 10/2000 | Weinreich | 160/191 |
| 6,149,094 | A | | 11/2000 | Martin et al. | 242/373 |
| 6,234,236 | B1 | | 5/2001 | Kuhar | |

FOREIGN PATENT DOCUMENTS

| | | |
|---|---|---|
| EP | 1 039 092 A2 | 9/2000 |
| FR | 883 709 | 7/1943 |
| FR | 2 337 809 | 8/1977 |
| GB | 13798 | 7/1893 |
| GB | 2 262 324 A | 6/1993 |

OTHER PUBLICATIONS

U.S. Appl. No. 09/835,343, filed on Apr. 16, 2001 and listing Otto Kuhar as inventor (24 pages).

U.S. Appl. No. 09/450,109, filed on Nov. 29, 1999 and listing Zazu Ciuca, Patrick Woods, Roger Palmer, Brian Ruggels, and Otto Kuhar as inventors (31 pages).

"The Theory and Design of Long-Deflection Constant- Force Spring Elements", by F. A. Votta Jr., Lansdale, PA (12 pages).

* cited by examiner

FIG. 3
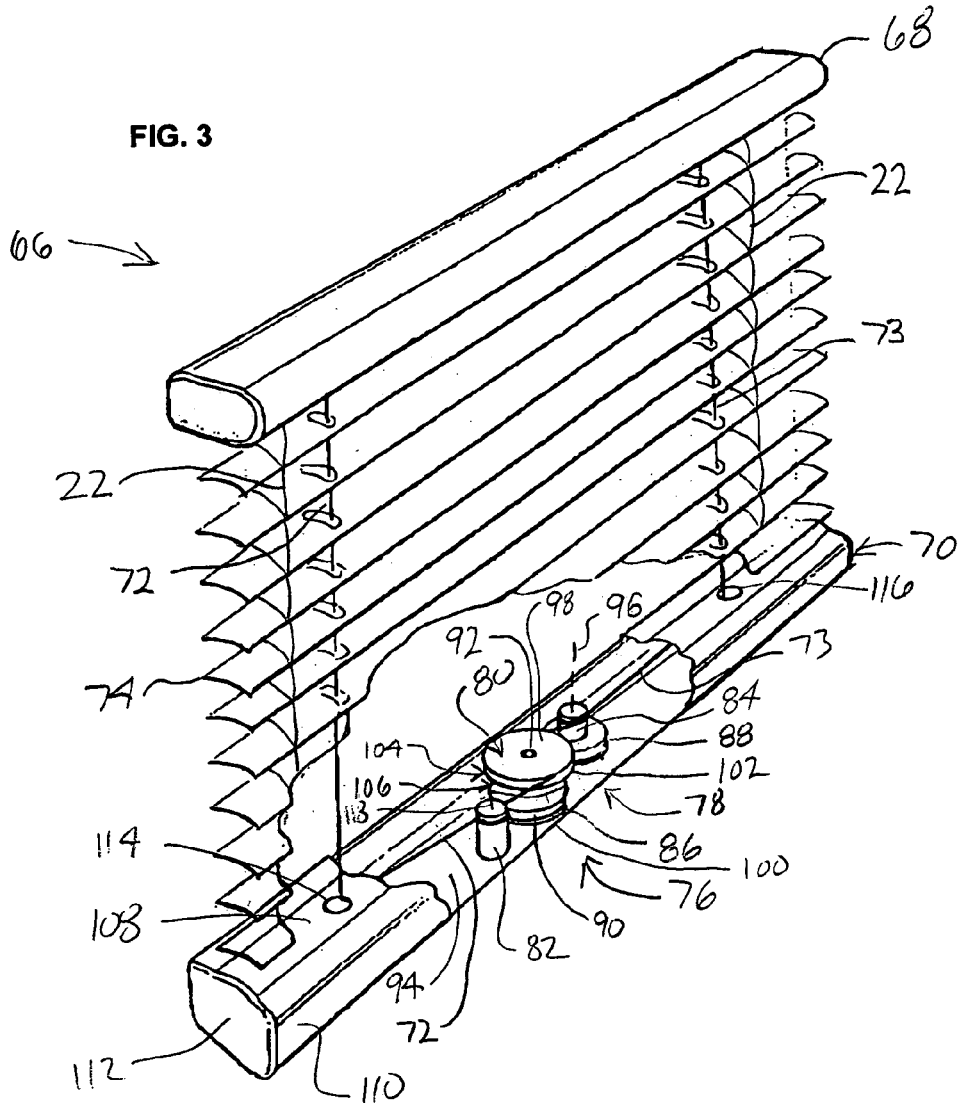
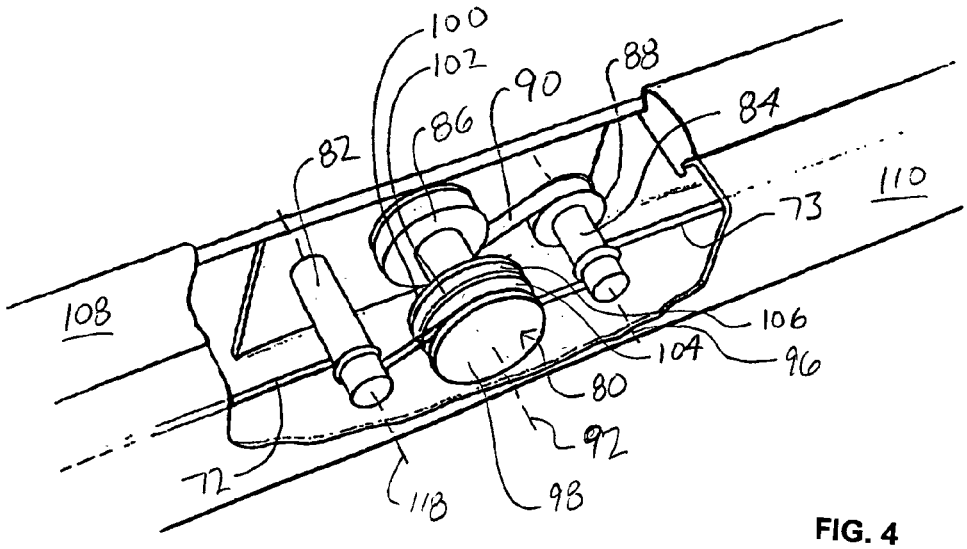
FIG. 4

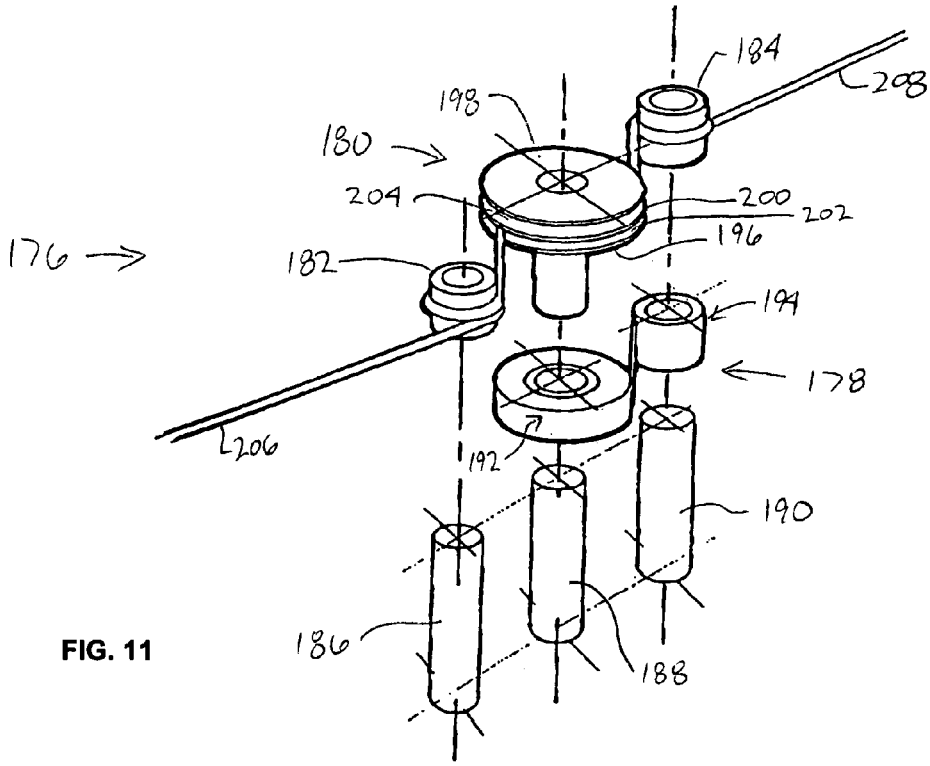
FIG. 11
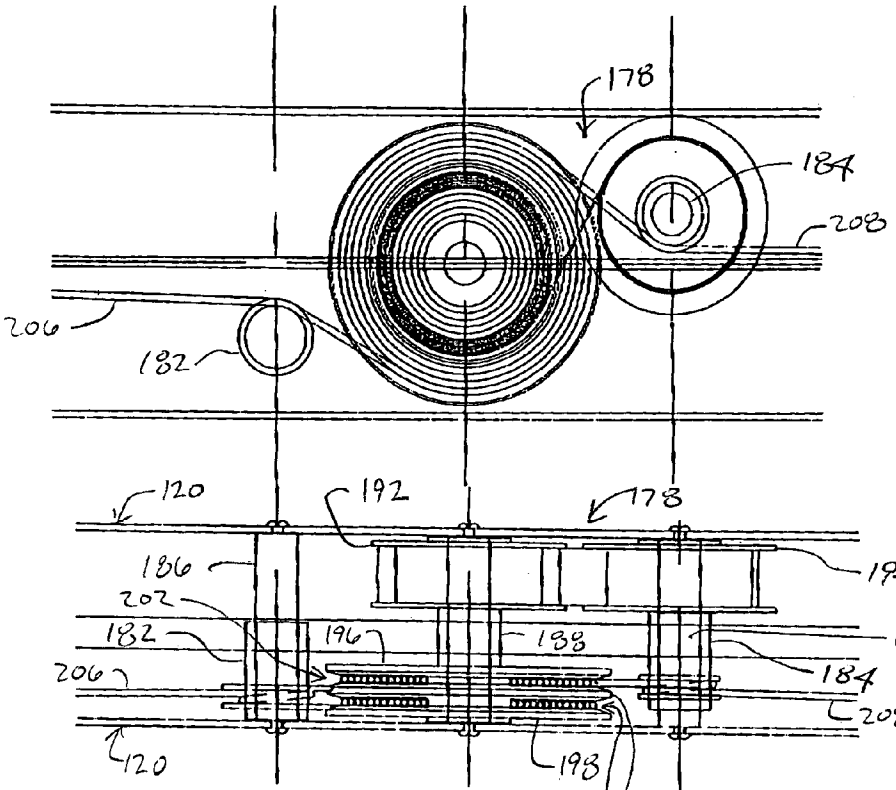
FIG. 9
FIG. 10

FIG. 13
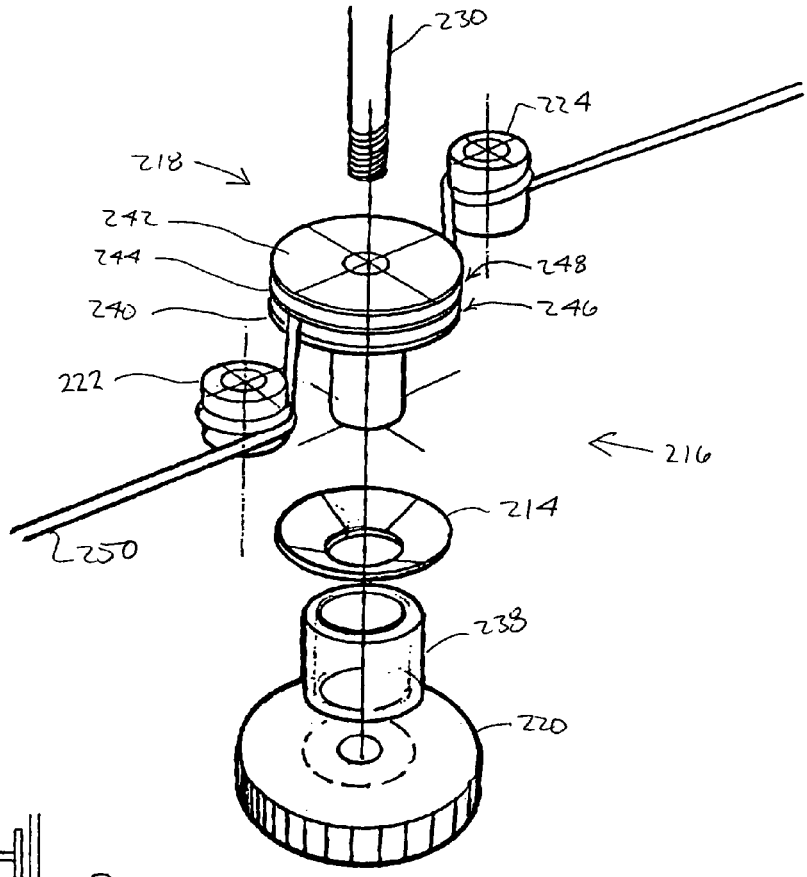
FIGURE 12B
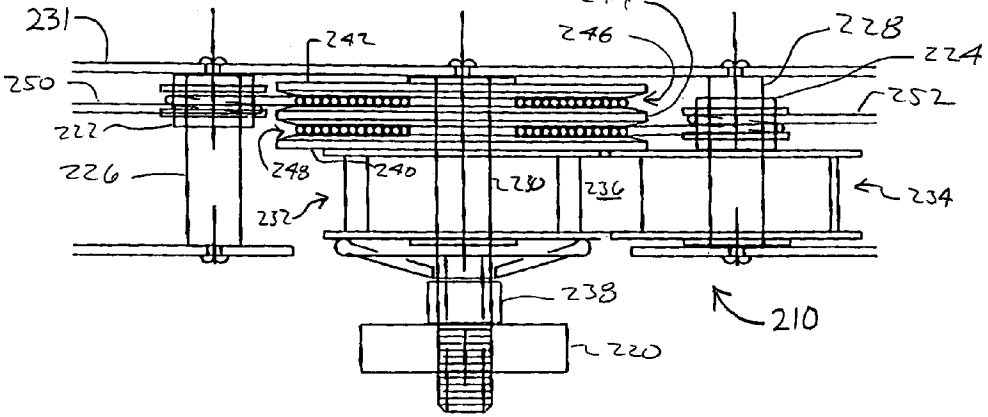
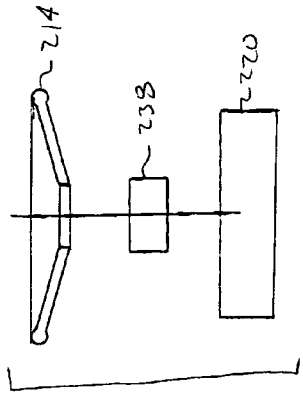
FIG. 12A

FIG. 27
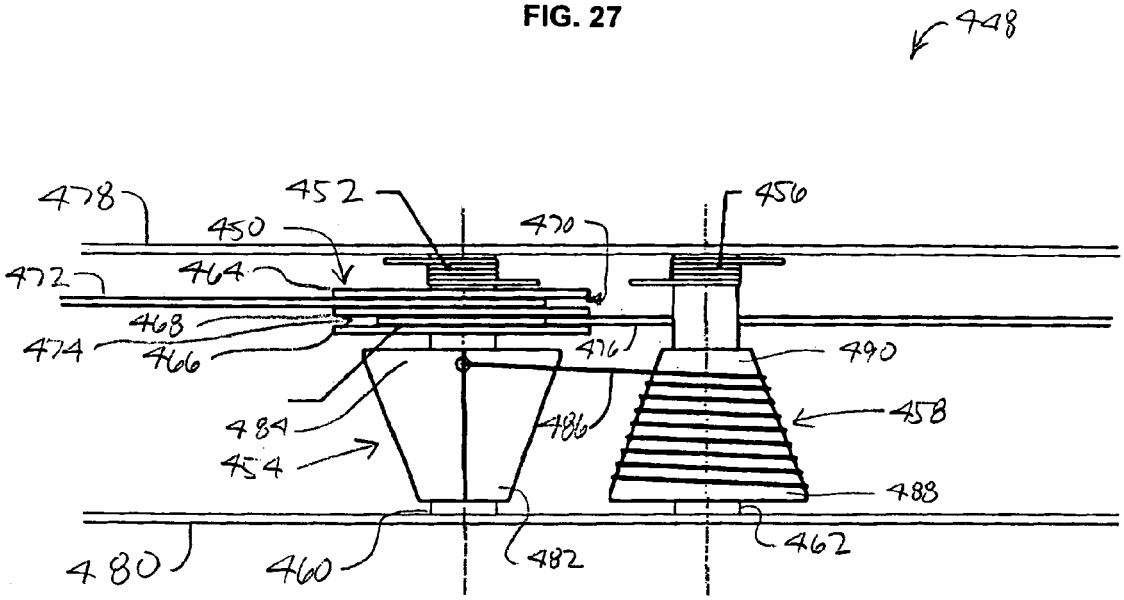
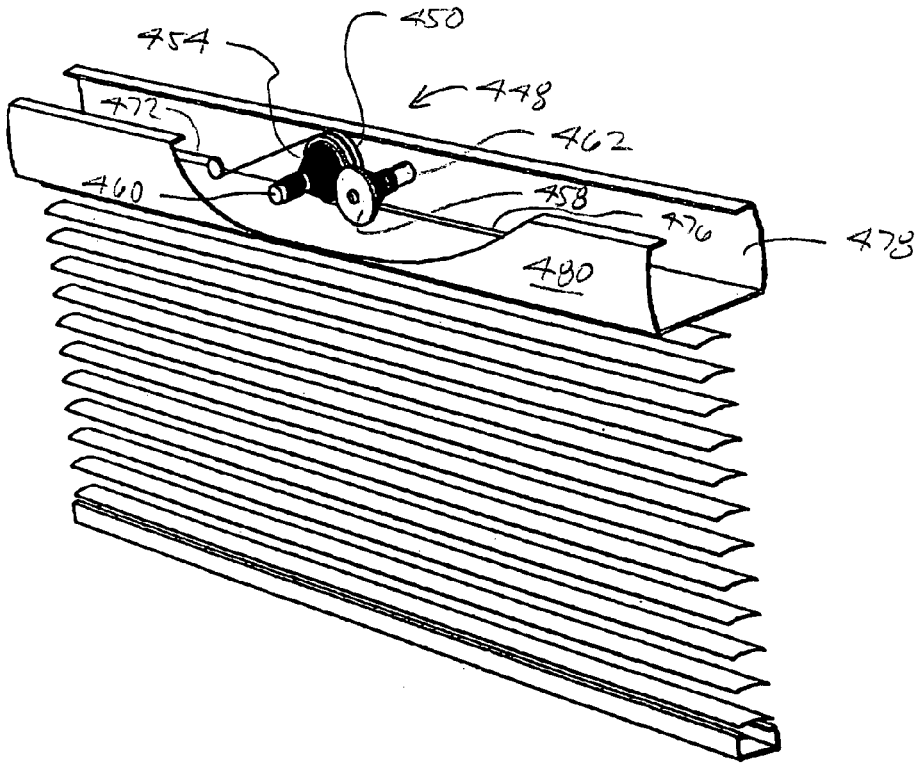
FIG. 28

CORDLESS BLIND

FIELD OF THE INVENTION

The invention relates to a window furnishing and more particularly a cordless blind.

BACKGROUND OF THE INVENTION

Venetian blinds are well known and typically include a head rail, a bottom rail, and a plurality of slats arranged between the headrail and the bottom rail. The slats are typically made from a variety of materials, such as metal, wood, plastic or other materials and supported by ladders.

Such blinds also typically include a tilt mechanism to enable the slats to move from a horizontal position to a nearly vertical position to open and close the blinds to affect the passage of light. As is also conventional with such systems, flexible line members or lift cords are coupled to the bottom rail, pass through the slats and into mechanisms within an upper headrail. The cords are employed to raise the bottom rail, accumulating individual slats as the bottom rail is raised. Because of gravity, the natural tenancy of the bottom rail and accumulated slat weight is to free fall. In many instances in the prior art, cord lock mechanisms are employed to lock the cord, thereby setting bottom rail, and the slats stacked thereon at a height determined by the user. Pleated and other types of shades also include a bottom rail and include similar raising, lowering and line member or cord lock mechanisms.

Spring motors are known to be provided to assist the elevating and lowering of a variable load such as that provided by a venetian blind type window covering. Spring motors conventionally comprise a flat ribbon of spring metal which is pre-stressed and coiled so as to have a natural or relaxed state in which the spring forms a tightly wound coil disposed on or in a spring storage or take up drum. The extended free end of the coil is attached to the hub of an output or spring drive drum onto which the spring is backwound by rotating the output drum in a direction to back or reverse wind the spring thereon. When the load to which the output drum is connected is released, the curling property of the spring causes it to rewind onto or into the storage drum toward its natural or relaxed state. Such spring motors as descried above can be of constant or variable force, depending upon the intended use of the motor. The characteristics of a variable force spring motor can be obtained in varying ways, but varying the radius of curvature of the spring member along the length thereof is conventionally the preferred method.

In connection with the use of such a spring motor and a venetian blind, as an example, a control drum or spool is mounted co-axially with the output drum for rotation therewith, and the flexible member or cord is wound onto the spool in a direction which provides for the unwinding of the cord to rotate the spring output drum in the direction for winding the spring member thereon from the spring storage drum. When the force necessary for such unwinding is relaxed, the spring member returns to its naturally coiled position whereby the spring output drum is rotated by the spring member in a direction to rewind the cord or belt onto the spool. In those blinds with locking mechanism, such rewinding of the cord onto the control drum is inhibited.

When raising or lowering a load such as the bottom rail and slats of a venetian blind accumulating on the bottom rail, a pair of cords may be wound on the spool in opposite directions with the free ends of the cords attached at the opposite ends of the bottom rail. When the bottom rail is lowered, the two cords unwind from the spool thus driving the spring output drum to wind the spring member thereon. Upward displacement of the bottom rail from a lowered position results in the spring member rewinding on the spring storage drum to rotate the spring output drum and thus the control drum in the direction to rewind the two cords. In elevating the lowering a suspended load of the foregoing example type, which is too heavy to provide desire displacement characteristics in connection with the upward and downward movement of the bottom rail, and using a single spring motor, many times it is necessary to provide a larger spring motor or operate two or more spring motors in tandem.

When it is desired, the spring motor may be designed to allow the balancing of the gravitational pull on the bottom rail and accumulated slats and the resisting force of the spring motor so that the weight, even though increasing, as additional slats are accumulated on the bottom rail as it is raised, the bottom rail may be released and stay at a predetermined height. However, this is difficult under many conditions.

A variety of factors may cause the blind to have different performance characteristics upon installation, including using different materials of slats, changing the size of the blind or the amount of window covering, the number of slats in the blind, the weight of the drive actuator, the weight of the bottom rail, etc. Without the blind being configured to be adjusted at the point of sale or by the consumer after the point of sale, it may be difficult to utilize the same motors on different types and sizes of blinds, particularly when the blind is customized at the point of sale per the consumer's requirements (e.g., size dimensions, etc.).

Accordingly, it would be advantageous to provide a blind in which lifting cords and cord mechanisms are eliminated from shades or blinds and relate to window covering systems which, inter alia, employ one or more spring motors to balance the weight of the accumulated window covering material, independent of the extent to which the blind or shade is raised or lowered. It would also be advantageous to provide a blind that utilizes an adjustable drive actuator to permit the adjustment of the blind's performance characteristics at the point of sale, after the blind has been customized, at the point of installation, or the like. It would also be advantageous to provide a cordless blind which a spring motor is used to eliminate conventional pull cord and cord lock mechanism and which is adjustable so that it is suitable for encountering a wide variety of loads making it unnecessary to design a specific motor for a specific end use.

It would be desirable to provide a blind with or providing anyone or more of these or other advantageous features.

SUMMARY OF THE INVENTION

The present invention relates to a cordless blind. The cordless blind includes a headrail, a bottom rail suspended from the headrail by a first cord and a second cord, a window covering disposed between the headrail and the bottom rail, and a drive actuator. The drive actuator includes a spring motor, a spool coupled to the spring motor, a first tensioning mechanism, and a second tensioning mechanism. The first and second tensioning mechanisms are configured to impact a resistant force on movement of the first and second cords, respectively.

The present invention also relates to a cordless blind. The cordless blind includes a headrail, a bottom rail suspended from the headrail by a first cord and a second cord, a window covering disposed between the headrail and the bottom rail, and a drive actuator. The drive actuator includes a spool, a spring motor coupled to the spool, a biasing element coupled to the spring motor and configured to provide a force biased against movement of the bottom rail, a bias relief mechanism coupled to the biasing element, the bias relief mechanism being configured to provide for selective application and relief of the biasing force by the biasing element.

The present invention further relates to a cordless blind. The cordless blind includes a headrail, a bottom rail suspended from the headrail, a window covering disposed between the headrail and the bottom rail, and a drive actuator. The drive actuator includes a pair of spring motors mounted in the headrail, a pair of pulleys mounted in the bottom rail, each spring motor includes a pair of flexible members coupled to the pair of pulleys and attached at one end to the headrail.

The present invention further relates to a drive actuator for a cordless blind having a headrail, a bottom rail suspended from the headrail, and a plurality of slats disposed between the headrail and the bottom rail. The drive actuator includes a constant biasing element, a generally rigid strap having a plurality of apertures, and a traction wheel. The traction wheel includes a plurality of cogs spaced apart a predetermined distance and extending from the circumference of the traction wheel. The cogs are configured to engage the apertures of the strap. The spacing between the cogs correspond to a plurality of apertures on strap so that movement of the of the strap rotates the traction wheel. The drive actuator also includes a biasing member, and a mandrel coupled to the traction wheel by the biasing member. The biasing member and mandrel are configured to bias the traction wheel in a certain position.

The present invention further relates to a drive actuator for a blind having a headrail, a bottom rail suspended from the headrail by a first and second cord, and a plurality of slats disposed between the headrail and the bottom rail. The drive actuator includes a storage drum having a first axis, an output drum mounted for rotation about a second axis parallel and spaced from the first axis, a perforated biasing member coupled to the storage drum and the output drum, and a spool having a plurality of cogs extending from an outer surface of the spool and configured to engage the perforated biasing member. The spool is rotated by movement of the perforated spring member between the storage drum and output drum. The spool includes a first and second slot which receive first and second cords, respectively.

The present invention further relates to a blind including a headrail, a bottom rail suspended from the headrail, a plurality of slats disposed between the headrail and the bottom rail, means for selective cordless manipulation of the bottom rail, and means for modifying the weight of the bottom rail.

The present invention further relates to a drive actuator for a cordless blind having a headrail, a bottom rail suspended from the headrail by a first and second cord, and a plurality of slats disposed between the headrail and the bottom rail. The drive actuator includes a slat actuator, a first ladder member coupled to the slat actuator and having a first arm and a second arm, a first ladder configured to support the plurality of slats and configured to the first and second arm of the first ladder member, and an actuator interface coupled to the slat actuator.

The present invention further relates to a method of customizing a blind. The method includes providing the blind to a customer at a retail outlet, the blind having an initial weight and including a head rail, a bottom rail coupled to the head rail, a window covering disposed between the head rail and the bottom rail, and a drive actuator with a spring motor operably coupled to the bottom rail; operating the drive actuator to observe performance characteristics of the blind; and adjusting one of weight, spring force, and friction of the blind to attain a particular performance characteristic.

The present invention further relates to a method of selling a customized blind. The method includes providing a blind having a head rail, a bottom rail coupled to the head rail, a window covering disposed between the head rail and the bottom rail and a drive actuator with a spring motor operably coupled to the bottom rail; altering the blind according to a customers preferences by altering the width of the blind or the amount of window covering; operating the blind to determine whether the bottom rail will move relative to the top rail when released by the operator; and adjusting one of the weight, spring force, and friction of the blind so that the bottom rail will not move relative to the top rail when released.

The present invention further relates to a method of in-store adjustment of a blind including a head rail, a bottom rail coupled to the head rail and having an initial weight, a window covering disposed between the head rail and the bottom rail, and a drive actuator. The method includes providing the blind; operating the blind to determine its performance characteristics; and adjusting the performance characteristics of the blind by increasing or decreasing the weight of the bottom rail.

The present invention further relates to various features and combinations of features shown and described in the disclosed embodiments.

BRIEF DESCRIPTION OF THE FIGURES

FIG. 3 is a fragmentary perspective view of a cordless blind according to an exemplary embodiment.

FIG. 4 is a fragmentary perspective view of a cordless blind according to an exemplary embodiment.

FIG. 9 is a top perspective view of a single take-up spool system according to an exemplary embodiment.

FIG. 10 is a front elevation view of the single take-up spool of FIG. 9.

FIG. 11 is a fragmentary exploded perspective view of the single take-up spool system of FIG. 9.

FIG. 12A is an elevation view of spring motor system according to an exemplary embodiment.

FIG. 12B is an exploded view of some components of the spring motor system of FIG. 12A.

FIG. 13 is an exploded view of the spring motor system of FIG. 12.

FIG. 27 is a fragmentary top elevation view of a cordless blind system according to an alternative embodiment.

FIG. 28 is a fragmentary perspective view of a blind employing the cordless blind system of FIG. 27.

DETAILED DESCRIPTION OF EXEMPLARY EMBODIMENTS

The exemplary embodiments shown in the FIGURES relate generally to the art of drive actuators with spring motors useful for a variety of applications, including window coverings such as venetian blinds and window shades. More specifically, the present exemplary embodiments relate to a drive actuator that may be adjusted to attain one or more desired performance characteristics. Performance characteristics of a blind may include the effort necessary to raise or lower the bottom rail, the speed of which the bottom rail may be raised or lowered, whether the bottom rail remains in a static position relative to the head rail when released (i.e., "balanced"), etc. The performance characteristics of the blinds and drive actuators shown in the FIGURES may depend on the customers preferences, and are intended to be variable, selectable, and adjustable by a retail sales associate, the installer, and/or the customer.

As shown in the FIGURES, according to any preferred embodiment, the blind is configured to be "balanced" at any of a variety of times (e.g., after a test operation at a retail sales location, after customization which may be done at the point of sale or prior to installation or the like after installation, periodically during its life, etc). A "balanced" blind is one that maintains its set position or arrangement when released by the operator after the bottom rail is raised or lowered relative to the head rail (i.e., to uncover/cover the window with window covering).

The performance characteristics, particularly whether a blind is "balanced," depends on a number of variables (including weight of the bottom rail plus any accumulated window covering ("ΣW"), force of the spring motor ("Fs"), and frictional force (both "naturally" occurring friction and friction "added" to the system collectively referred to as f). A blind is balanced when the friction force is greater than the absolute value of the difference of the weight and the spring motor force (i.e., $f > |\Sigma W - Fs|$).

As shown in the FIGURES, the drive actuators allow for an adjustment of one or more of the variables (e.g., weight adjustment, spring force adjustment, a friction adjustment, etc.). For example, a member may be provided that is engageable with one of a coupled drive and drive actuator for a spring motor so as to permit adjustment of the force necessary to affect movement of motion of the coupled drive. In this manner, adjustment of the adjustable friction member so that a single spring motor design (and under heavy loads or severe conditions even a coupled pair of spring motors) may be employed for a variety of uses such as window blinds and shades of differing sizes, weights and material composition, is facilitated.

Figure 1:
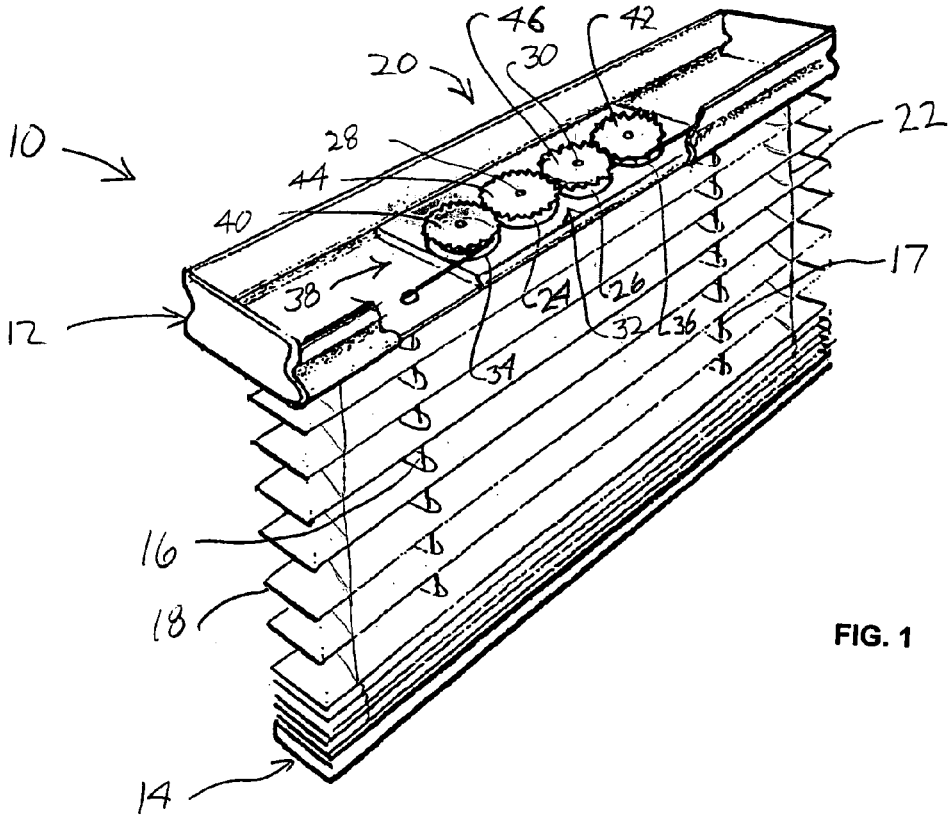
FIG. 1 is a fragmentary perspective view of a cordless blind according to an exemplary embodiment.

FIG. 1 illustrates a blind 10 having a head rail 12, a bottom rail 14 suspended from head rail 12 by a first and second cord 16, 17, a window covering (shown as a plurality of slats 18) disposed between head rail 12 and bottom rail 14, and a drive actuator with a spring motor 20 mounted in head rail 12.

Referring to FIG. 1, blind 10 provides spring motor 20 mounted in a horizontal configuration and located in head rail 12. Such a horizontal configuration is intended to decrease the overall height of head rail 12. When bottom rail 14 is in a lowered position, slats 18 are independently supported from head rail 12 by a flexible ladder 22 and are evenly vertically spaced from one another. Bottom rail 14 is connected to terminal ends of flexible ladder 22. As bottom rail 14 is raised, slats 18 stack upon one another and are supported by bottom rail 14. Bottom rail 14 and the stacked slats 18 are supported by first and second cords 16, 17. First and second cords 16, 17 are coupled to spring motor 20 mounted in head rail 12.

Spring motor 20 includes a storage drum 24 and an output drum 26 mounted for rotation about a first and second axis 28, 30, respectively. Storage drum 24 and output drum 26 are connected by a spring member 32. Spring member 32 is tightly wound on storage drum 24 and is connected to output drum 26. Storage and the output drums 24, 26 are coupled to head rail 12 at the first and second axis 28, 30, respectively. A first and second cord spool 34, 36 are also coupled to head rail 12. As shown, lift cords 16, 17 are wound about the first and second spools 34, 36.

A coupled drive 38, includes a first and second gear 40, 42 connected respectively to the first and second spool 34, 36. Coupled drive 38 further includes a third and fourth gear 44, 46 connected respectively to storage drum 24 and output drum 26. The coupling of the drive by the gears forces rotation of storage drum 24 or output drum 26 in a first direction about its axis and the other of storage drum 24 or output drum 26 in an opposite direction, which allows winding and unwinding of spring member 32 between the drums 24, 26. Because the third and fourth gears 44, 46 form part of coupled drive 38, it is easy to ascertain that if first cord 16 is moving to the left, second cord 17 is moving to the right, and bottom rail 14 is lowering. Further, because of coupled drive 38, as first cord 16 is pulled to the left, spring member 32 starts winding on output drum 24 and unwinding from storage drum 26.

In FIG. 1, spring motor 20 and coupled drive 38 are mounted such that their axes 28, 30 are in a vertical position. Such a configuration gives an overall appearance of the coupled drive as a horizontal spring mount configuration located in head rail 12. To adjust blind 10, the user grasps bottom rail 14 and raises or lowers it to the desired position. Raising bottom rail 14 allows spring tension in spring member 32 to wind or collect spring member 32 about storage drum 24, thereby turning third and fourth gears 44, 46 so that first and second cord 16, 17 may be collected by first and second spools 34, 36.

Figure 2:
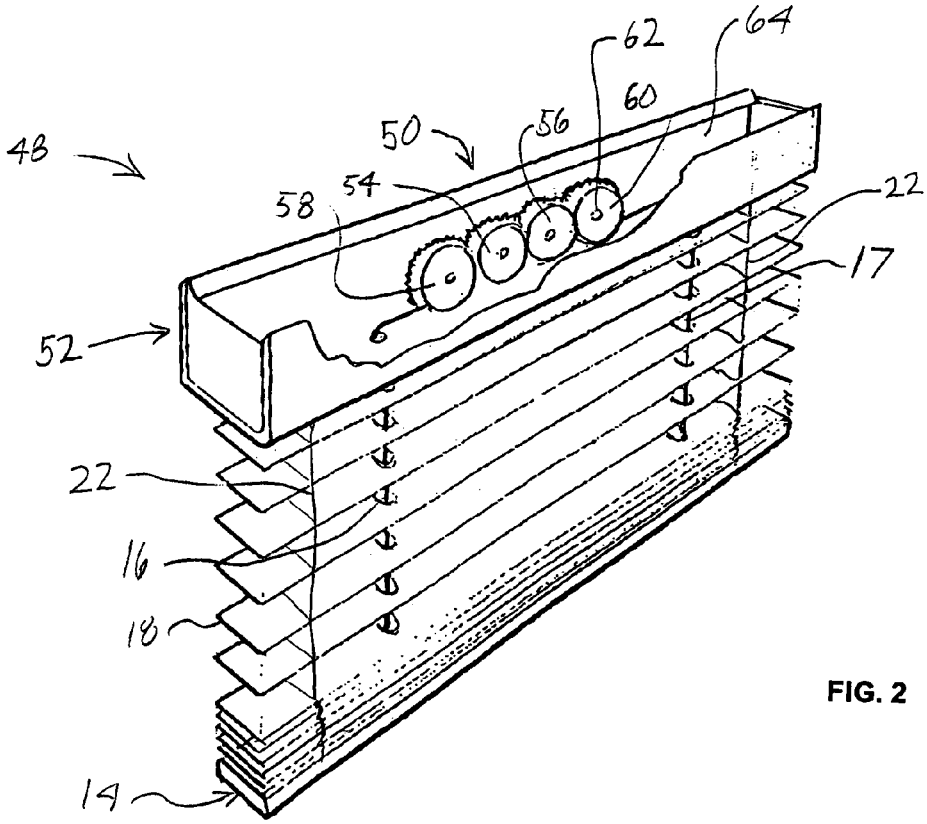
FIG. 2 is a fragmentary perspective view of a cordless blind according to an exemplary embodiment.

FIG. 2 on page 1 discloses a blind 48 having a spring motor 50 mounted vertically and located in a head rail 52. A first and second spool 58, 60 and an output and a storage drum 54, 56 are mounted such that their axes 62 are in a horizontal position. Spools 58, 60 and Drums 54, 56 are coupled to a side wall 64 of head rail 52.

FIGS. 3 and 4 illustrate a blind 66 having a head rail 68, a bottom rail 70 suspended from head rail 68 by a first and second cord 72, 73, a window covering (shown as a plurality of slats 74) disposed between the head rail 68 and the bottom rail 70. Bottom rail 70 includes a coupled drive actuator 76 disposed in a generally horizontal configuration. Drive actuator 76 includes a spring motor 78, a spool 80, and first and second winding members 82, 84. Spring motor 78 includes a storage drum 86, an output drum 88, and a spring member 90.

Referring to FIG. 3, storage drum 86 is mounted for rotation about a first axis 92 and is coupled to a bottom wall 94 of bottom rail 70. Output drum 88 is mounted for rotation about a second axis 96. Spring member 90 is tightly wound on storage drum 86 and coupled to output drum 88. Winding members 82, 84 may be any of a variety of members (e.g., tension pulleys; members made from materials having a relatively high coefficient of friction such as rubber or plastic; etc.) configured to impart resistance or friction to first and second cords 72, 73 as they slip about winding members.

Spool 80 is mounted for rotation about first axis 92 and includes a first outer wall 98, a second outer wall 100, and a middle wall 102. First outer wall 98 and middle wall 102 form a first slot 104, and second outer wall 100 and middle wall 102 form a second slot 106. As shown, first cord 72 is wound upon spool 88 in the first slot 104. Second cord 73 is wound upon spool 80 in second slot 106. Cords 72, 73 are wound in separate slots 104, 106 upon the same spool so that if first cord 72 is wound clockwise on spool 80, second cord 73 is wound clockwise on spool 80.

Bottom rail 70 has a closed construction such that there is bottom wall 94, a top wall 108, side walls 110, and end walls 112. Top wall 108 of bottom rail 70 includes a first and second aperture 114, 116 through which first and second cords 72, 73 pass therethrough. First winding member 82 is located intermediate the first aperture 114 and spool 80. First cord 72 is wound upon first winding member 82. Second winding member 84 is located intermediate second aperture 116 and spool 80. Second cord 73 is wound around second winding member 84. First and second winding member 82, 84 is mounted to bottom wall 94 of bottom rail 70 at second axis and third axes 96, 118.

Placing drive actuator 76 and [slat adjustment in a horizontal configuration] in the bottom rail is intended to reduce the profile of head rail 68 and bottom rail 70, apportion weight in the blind, and increase structural rigidity.

First and second winding members 82, 84 are configured to provide tension or friction to the system so that the bottom rail rests in a static position after being released by the user. The diameter of first and second winding members 82, 84 can be varied in size according to the size of blind 106 and the blind material (i.e., weight of slats 74). By varying the diameter material, or configuration of winding members 82, 84, the friction in the system can be adjusted.

Referring now to FIG. 4, spool 80, storage drum 86, output drum 88, and first and second winding members 82, 84 are mounted such that their axes 92, 96, 118 are in a generally horizontal position, and are connected to one of sidewalls 110 of bottom rail 70. Placing spring motor 78 and slat adjustment in a vertical configuration in the bottom rail 70 is intended to minimizes the depth of bottom rail 70 wherein the depth is measured between the sidewall 110.

Referring to FIGS. 3 and 4, the horizontal and vertical configurations of coupled drive actuator 76 can be fitted with any of a variety of different sizes of springs depending on the overall configuration of the blind, which depends on the material and customized structure following in-store sizing. According to a preferred embodiment, spring motor 78 is configured to be fitted with one or more of six different sizes of springs, including a spring that is ⅞ inches in diameter. According to an exemplary embodiment, the horizontal and vertical configurations in bottom rail 70 may further include a counterweight with a brake (not shown). The counterweight is preferably 1½ ounces. According to a preferred embodiment, the counterweight, and the brake are mounted on the bottom rail.

FIGS. 5-11 disclose drive actuators for a blind that are configured to keep a bottom rail level so that when the blind is operated, ends of the bottom rail raise and lower at approximate equal heights.

Figure 5:
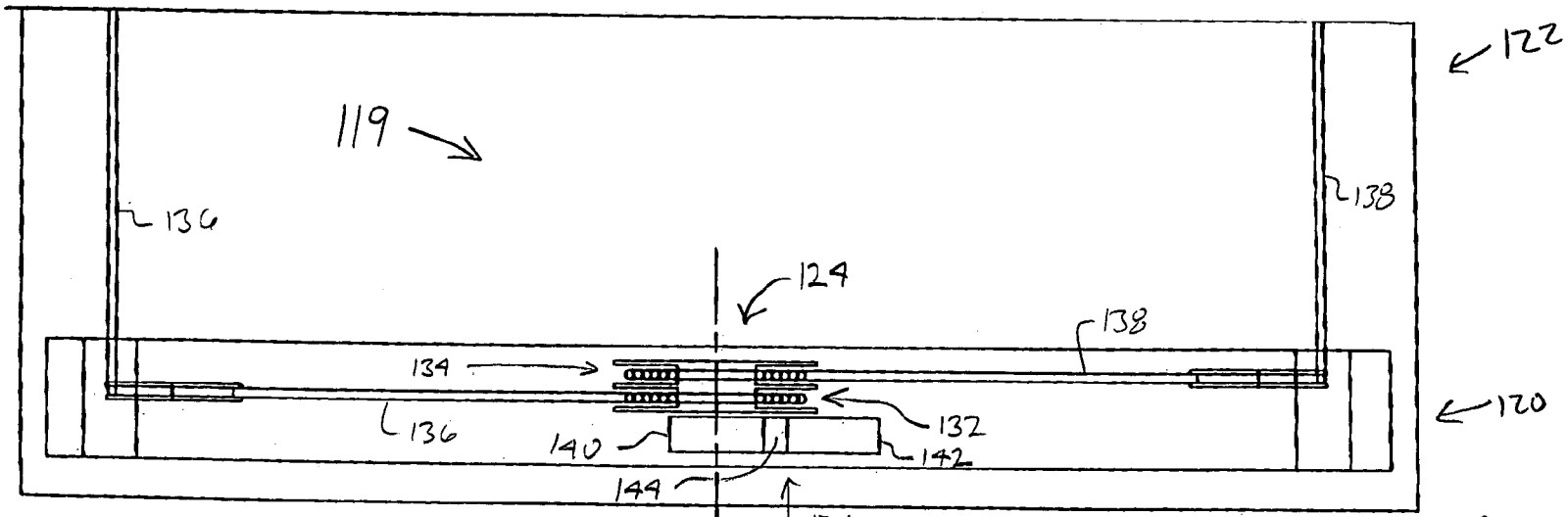
FIG. 5 is a fragmentary front elevation view of a cordless blind according to an exemplary embodiment.
Figure 6:
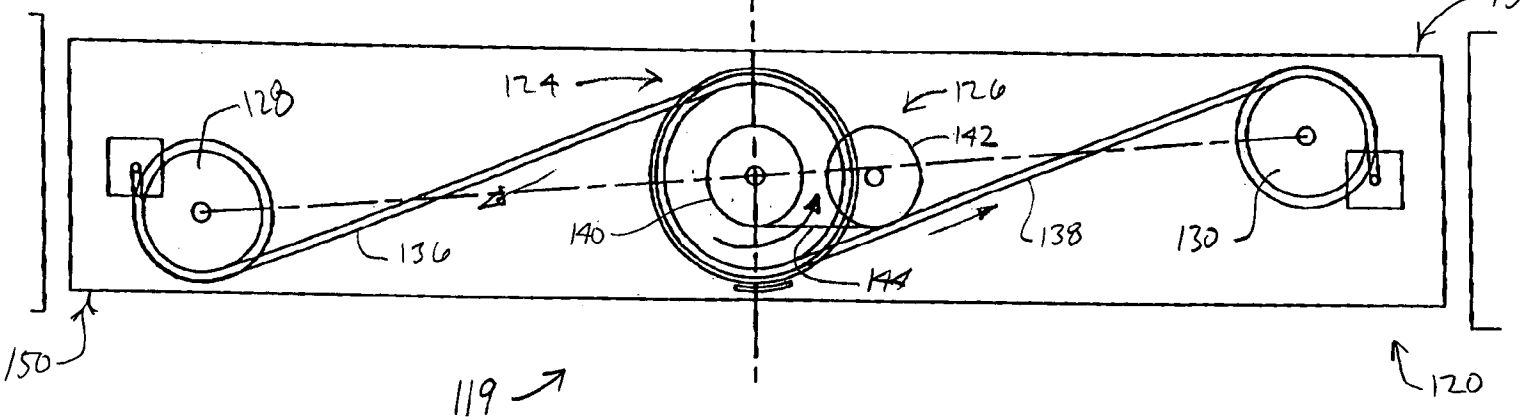
FIG. 6 is a fragmentary bottom elevation view of the cordless blind of FIG. 5.

FIGS. 5 and 6 disclose a drive actuator 119 located in a bottom rail 120 of a blind 122. Drive actuator 119 includes a single take-up spool 124, a spring motor 126, a first wheel 128 and a second wheel 130 (which are intended to provide friction in the system to offset the spring force). The single take-up spool 124 includes a first slot 132 and a second slot 134. A first cord 136 passes across first wheel 128 and winds around spool 124 in first slot 132. A second cord 138 passes over second wheel 130 and winds around spool 124 in second slot 134. Because first and second slots 132, 134 are located on the same spool (spool 124), it is easy to ascertain that if first cord 136 winds around in a clockwise direction, second cord 138 must also wind around spool 124 in a clockwise direction. Preferably, the width of first slot 132 and second slot 134 is only slightly larger than the diameter of first and second cords 136, 138. Single take-up spool 124 having such first and second slots 132, 134 with diameters of first and second cords 136, 138 forces cords 136, 138 to wrap up on themselves thereby keeping bottom rail 120 substantially parallel.

Spring motor 126 includes a storage drum 140 and an output drum 142. Storage drum 140 is coupled to spool 124 and output drum 142 is coupled to rail 120. A spring member 144 connects storage drum 140 and output drum 142. Spring member 144 can be wound about storage drum 140 and output drum 142 in identical directions or spring member 144 can be wound about storage drum 140 and output drum 142 in opposite directions.

Figures 7, 8:
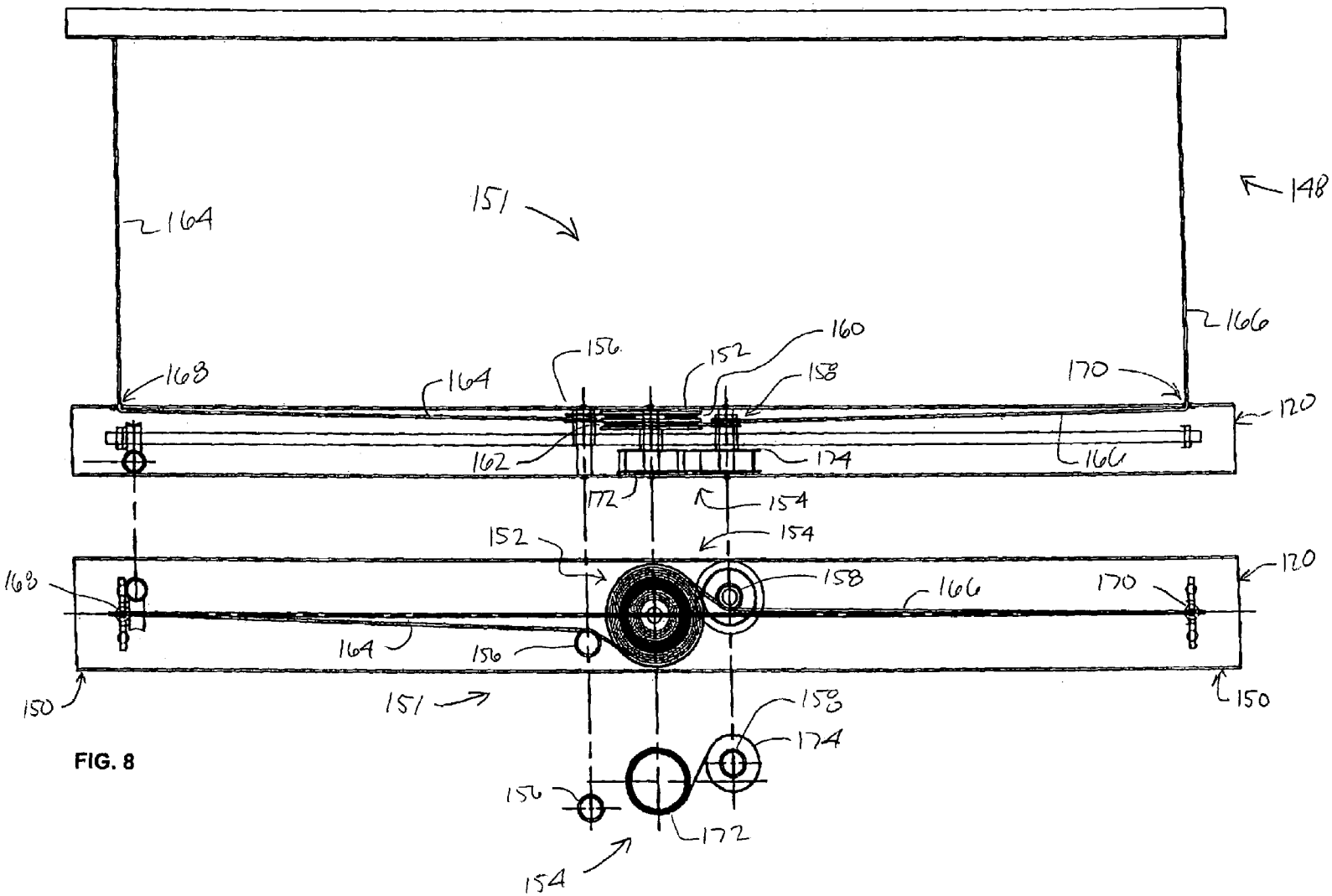
FIG. 7 is a fragmentary front elevation view of a cordless blind according to an exemplary embodiment.
FIG. 8 is a fragmentary bottom elevation view of the cordless blind of FIG. 5.

FIGS. 7 and 8 disclose front and top views of a drive actuator 151 with a "constant force" arrangement having a single, double-slotted take-up spool and a pair of secondary tensioning pulleys mounted horizontally in bottom rail 120 to keep bottom rail 120 parallel (relative to the head rail (not shown)). Bottom rail 120 includes a spool 152, a spring motor 154, and a first and second tensioning pulley 156, 158. Spool 152 is mounted to bottom rail 120 and has a first and second slot 160, 162 for storing a first and second cord 164, 166, respectively. First cord 164 enters bottom rail 120 through a first aperture 168 and winds around first tensioning pulley 156 at least once and then winds around spool 152 in first slot 160. Second cord 166 enters bottom rail 120 through a second aperture 170 and winds around second tensioning pulley 158 at least once and then winds around spool 152 in second slot 162. One of a storage drum 172 and a output drum 174 is mounted on the same axis as spool 152. The other of storage drum 172 and the output drum 174 is mounted on the same axis as second tensioning pulley 158 or first tensioning pulley 156.

FIGS. 9, 10, and 11 disclose a drive actuator 176 configured to operate in either a horizontal or vertical position. Drive actuator 176 includes a spring motor 178, a spool (shown as a single "take-up" spool 180), a first and second tensioning pulley 182, 184, and a first, second, and third axles 186, 188, 190.

Spring motor 178 includes a storage drum 192 and an output drum 194. Storage drum 192 is mounted on second axle 188 and output drum 194 is mounted on third axle 190.

Spool 180 includes a first outer wall 196, a second outer wall 198, and a middle wall 200 located intermediate first and second outer walls 196, 198. A first slot 202 is formed by first outer wall 196 and the middle wall 200. A second slot 204 is formed by second outer wall 198 and the middle wall 200. Spool 180 is mounted on second axle 188 adjacent to storage drum 192. First tensioning pulley 182 is rotatably coupled to first axle 186 and second tensioning pulley 184 is rotatably coupled to third axle 190. A first cord 206 is wound on first tensioning pulley 182 and then is wound on spool 180 in first slot 202. A second cord 208 is wound on second tensioning pulley 186 and is then wound on spool 180 in second slot 204. If first cord 206 is wound around spool 180 in a clockwise direction, second cord 208 is also wound around spool 180 in a clockwise direction.

First and second tensioning pulleys 182, 184 are intended to provide friction to drive actuator 176. The amount of friction that the pulleys provide can be varied according to the size of the spring, the size of the miniblind, and the miniblind material type.

Figure 14:
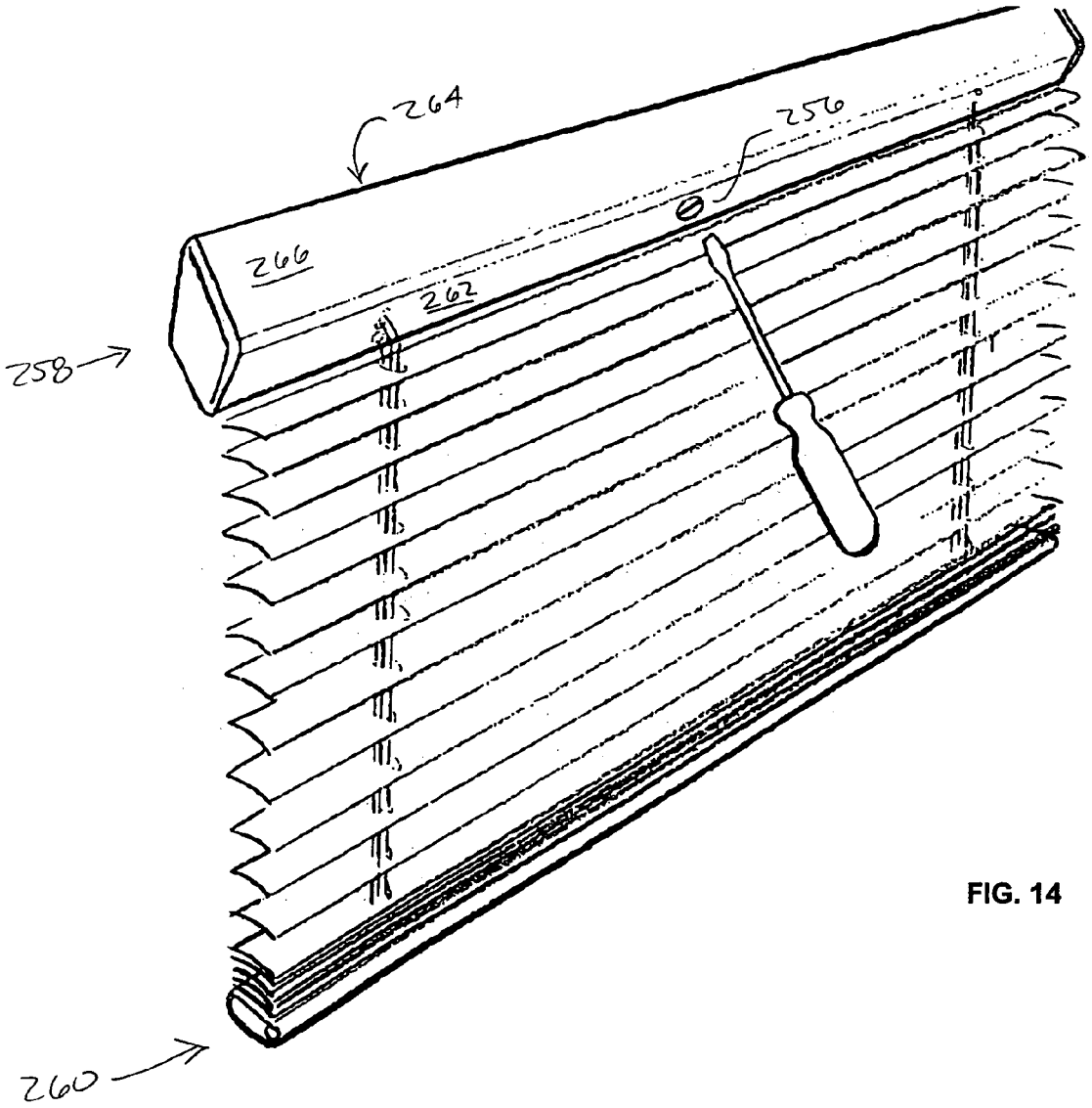
FIG. 14 is a perspective view of a cordless blind having a drag brake system.

FIGS. 12A-22 disclose drive actuators having a brake, lock, and/or track mechanism configured to allow the user to selectively raise, lower, or statically position a bottom rail. As shown in FIGS. 12-14, the blind includes a balancing adjustment device configured to allow the consumer to adjust the balance of forces and/or performance of the drive actuator (e.g., weighting, resistance, spring tension, friction, etc.).

FIGS. 12B and 13 disclose a drive actuator 216 with a spring motor 210 that can be selectively adjusted or tuned by the balancing adjustment device. As shown in FIGS. 12A, 12B, and 13, the balancing adjustment device is a biasing relief mechanism (shown as a knob 220) is configured to increase or decrease pressure on a spring in spring motor 210. According to a preferred embodiment, the spring preferably is a belleville spring. By adjusting the pressure on this spring, a spring motor providing a larger spring force can be used for a predescribed range of blind sizes.

Referring to FIG. 13, drive actuator 216 also includes a spool 218, spring 214, knob 220, first and second tensioning pulleys 222, 224, spring motor 210, and first, second, and third axles 226, 228, 230. First, second, and third axles 226, 228, 230 are connected to an adjacent wall (e.g., wall 231) by any conventional means and arranged such that third axle 230 is intermediate first and second axles 226, 228.

Spring motor 210 includes a storage drum 232 and an output drum 234. A spring member 236 is connected to storage drum 232 and output drum 234 to form spring motor 210. Storage drum 232 is positioned adjacent spool 218 and intermediate spring 214 and spool 218. A spacer 238 is inserted on third axle 230 and is positioned between spring 214 and knob 220. Knob 220 is threadably coupled to third axle 230. As the operator rotates knob 220 onto third axle 230, knob 220 presses spacer 238 against spring 214, thereby transferring pressure to storage drum 232 of spring motor 210. Drive actuator 216 can also be configured so that the spring pressure also applies pressure to the spool.

First tensioning pulley 222 is rotatably mounted to first axle 226. Second tensioning pulley 224 is rotatably mounted to second axle 228. First and second axles 226, 228 are mounted to one wall and can also be attached to an opposing wall.

As shown in FIG. 12B, output drum 234 is rotatably mounted to second axle 228 and is configured to take up spring member 236 as the bottom rail is lowered.

Spool 218 includes a first outer wall 240, a second outer wall 242, and a middle wall 244 located intermediate of first and second outer walls 240, 242. A first slot 246 is formed by first outer wall 240 and the middle wall 244. A second slot 248 is formed by second outer wall 242 and the middle wall 244. A first cord 250 enters drag brake system 216 and winds on first tensioning pulley 222, preferably wrapping around the pulley once. First cord 250 then wraps on spool 218 in first slot 246. A second cord 252 enters drag brake system 216 and winds on second tensioning pulley 224, preferably wrapping around the second tensioning pulley at least once. Second cord 252 is then wound on spool 218 in second slot 248. Because first and second cords 250, 252 wrap in first and second slots 246, 248 on a single spool 218, it is easy to ascertain that if the first cord wraps on the spool in a clockwise direction, the second cord also wraps on the spool in a clockwise direction.

Figure 15:
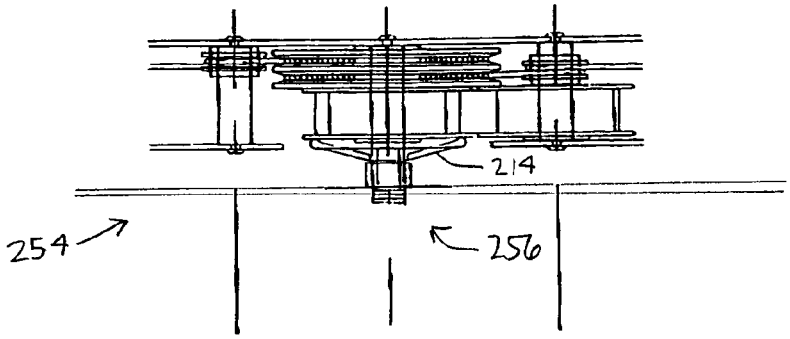
FIG. 15 is an elevation view of drag brake system of FIG. 14.

FIG. 14 discloses a drive actuator 254 configured to be adjusted by turning a balancing adjustment device own as a screw 256). Screw 256 may be coupled to a D/Y resizer. Drive actuator 254 shown in FIG. 15 is similar to that shown in FIGS. 12 and 13, but instead of a knob adjustment, FIGS. 14 and 15 disclose screw 256 to vary the spring pressure created by spring 214. As shown in FIGS. 1, 2, 3, and 4, this spring mount configuration can be located in a head rail 258 or a bottom rail 260. If drive actuator 254 is mounted in head rail 258, screw 256 is preferably mounted on a bottom wall 262 of head rail 258. In other embodiments, screw 256 can be mounted on a top wall 264 or a first wall 266 or a second wall (not shown). According to a preferred embodiment, screw 256 is mounted in a location that permits easy adjustment of the brake by an end user. However, the screw 256 adjuster may also be located in an inconspicuous location such as the top wall, front wall, or bottom wall of the head rail.

Figure 16:
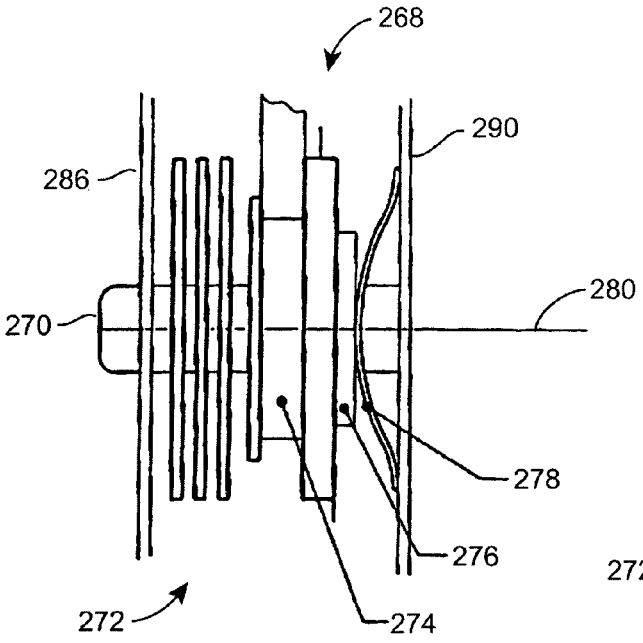
FIG. 16 is a top elevation view of a friction brake system according to an exemplary embodiment.
Figure 17:
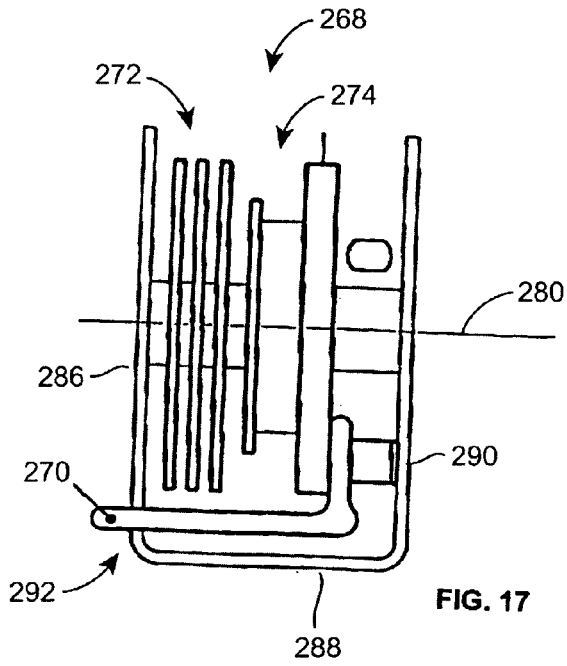
FIG. 17 is a side elevation view of the friction brake system of FIG. 16.
Figure 18:
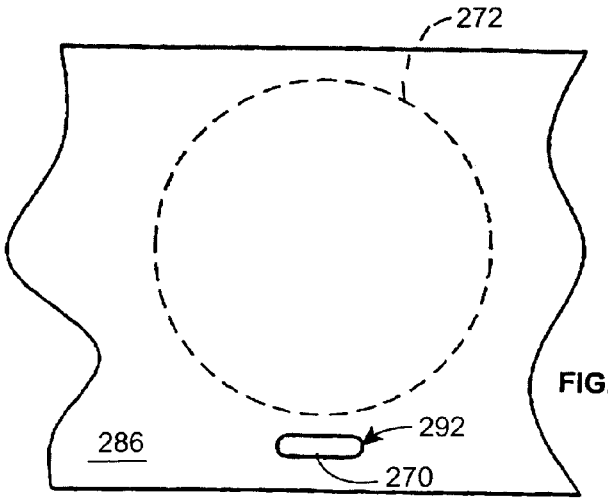
FIG. 18 is a front elevation view of the friction brake system of FIG. 16.

FIGS. 16, 17, and 18 disclose a drive actuator 268 configured to provide convenient release of a friction brake. Drive actuator 268 includes a release button 270, a double take-up spool 272, a constant force spring motor 274, a brake pad 276, a spring 278, and an axle 280. Preferably, double take-up spool 272, constant force spring motor 274, and brake pad 276 are mounted along axle 280. The configuration of spool 272 and constant force motor 274 are similar to that illustrated in FIGS. 12, 13, 14, and 15.

The rail (e.g., head rail or bottom rail) that drive actuator 268 is mounted in includes a first side wall 286, a bottom wall 288, and a second side wall 290. Axle 280 extends between first side wall 286 and second side wall 290. Adjacent first side wall 286, spool 272 is coupled to axle 280. Between spool 272 and second side wall 290 and adjacent to spool 272, constant force spring motor 274 is also mounted on axle 280. Spring 278 is located between second side wall 290 and constant force spring motor 274. Spring 278 is configured to be in a compressive state and therefore creating sufficient friction such that spool 272 and the constant force spring are maintained in a static position without regard to the position of the bottom rail. Brake pad 276 is disposed between spring 278 and constant force spring motor 274, and configured to transmit the compressive force from spring 278 to constant force spring motor 274 and spool 272.

Release button 270 is coupled to drive actuator 268 and extends through an aperture 292 in first side wall 286 of the head rail or bottom rail. When release button 270 is depressed, the compressive force, and therefore the frictional force, is relieved or unloaded from spool 272 and constant force spring motor 274. When the compressive force is relieved from spool 272 and spring motor 274, the user can adjust the elevated position of the bottom rail.

The compressive force of spring 278 operates as a friction brake acting on the spring motor 274, which can be relieved by pressing release button 270 on the front of the rail. Preferably, drive actuator 268 and the spring motor 274 are mounted in the same rail and preferably mounted in the bottom rail.

Figure 19:
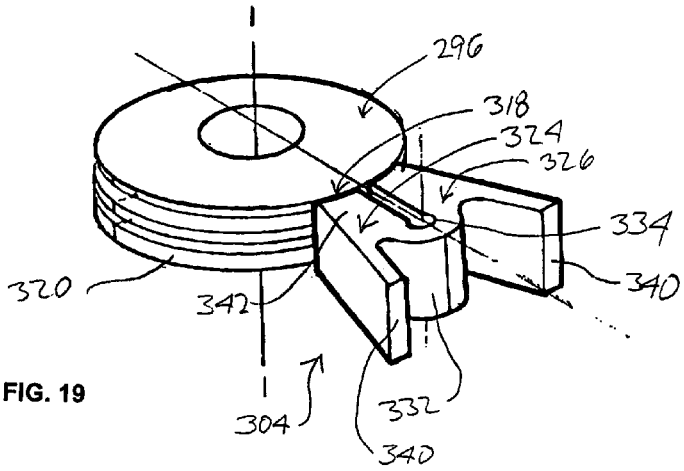
FIG. 19 is a perspective view of a friction brake mechanism according to an alternative embodiment.
Figure 20:
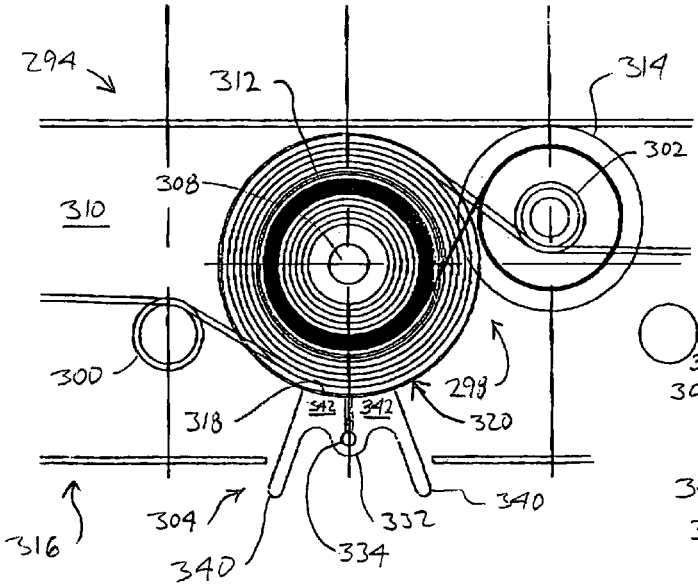
FIGS. 20 and 21 are fragmentary top elevation views of the friction brake system of FIG. 19.
Figure 21:
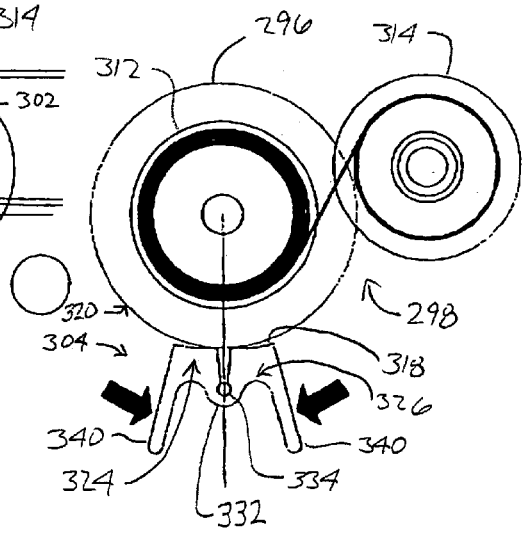

According to an alternative embodiment, shown in FIGS. 19, 20, and 21, a drive actuator 294 includes a spool 296, a spring motor 298, first and second tensioning pulleys 300, 302, and a friction brake mechanism, shown as a squeeze release brake or clip 304. Spool 296 is rotatably coupled to an axle 308, which is connected to an adjacent wall 310. Spring motor 298 includes a storage drum 312 and an output drum 314. Storage drum 312 is connected to spool 296 and rotatably connected to axle 308.

According to a preferred embodiment, squeeze release brake 304 is located in a bottom rail 316 and acts as a friction brake on spool 296. Brake 304 is mounted adjacent an outside surface 320 of spool 296 and is coupled to a bottom wall 322 of bottom rail 316. Brake 304 includes first and second portions 324, 326 that project away from spool 296 and through an aperture 328 in a side wall of bottom rail 316, a friction surface 318 configured to engage outer surface 320 of the spool 296, a hinge 332 that connects first and second portions 324, 326 of brake 304, and an aperture 334 configured to receive an axle 336 that is connected to bottom wall 322 of bottom rail 316. First and second portions 324, 326 are symmetrical about a plane and about slot 338. First and second portions 324, 326 each include a flange 340 and a base 342, wherein a slot 338 extends from aperture 334 to friction surface 318 and separates the first and second portions 324, 326.

The friction force on spool 296 by friction surface 318 is relieved by operating brake 304. Brake 304 is operated by squeezing flange 340 together. When flanges 340 are squeezed together, brake 304 flexes about hinge 332 and axle 308. When brake 304 flexes, the amount of surface area of friction surface 318 in contact with spool 296 decreases. At a point, the friction caused by the contact of friction surface 318 to spool 296 is relieved enough for spool 296 and spring motor 298 to rotate. When brake 304 system is in a reduced friction brake status, bottom rail 316 can be raised or lowered by the user. When the user places bottom rail 316 in the desired position, the user releases the squeezing pressure from the flanges 340 of brake 340, thereby reengaging friction surface 318 to spool 296.

Figure 22:
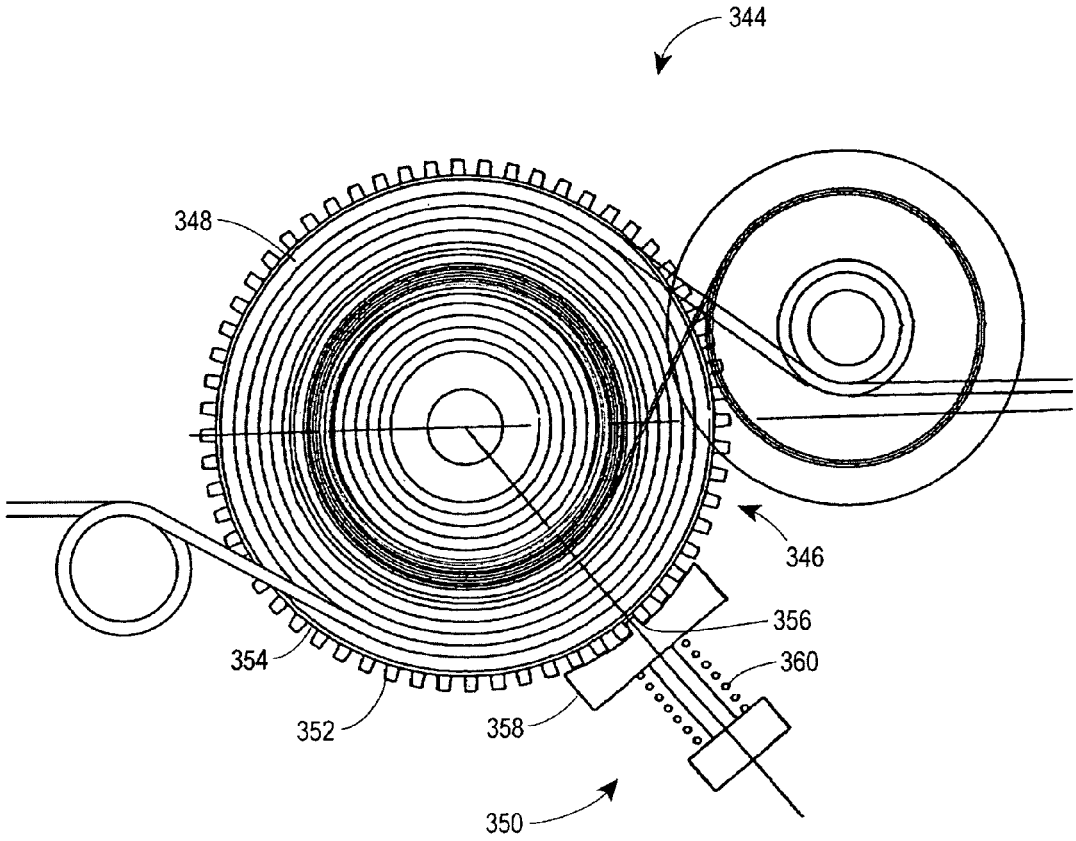
FIG. 22 is a top elevation view of a brake lock release system for a blind according to an exemplary embodiment.

FIG. 22 discloses a drive actuator 344 that allows the user to release the spring and reset a positive lock when the blind is in a desired correct position. Drive actuator 344 includes a spring motor 346, a spool 348, and a brake release 350. A plurality of projections 352 extend radially from an outer surface 354 of spool 348. A projection 356 extends from a braking shoe 358 of brake release 350 and is configured to engage projections 352 for an interference braking action. A spring 360 biases braking shoe 358 so that it is engaged with spool 348. In operation, the spring 360 and reset braking shoe 358 when the blind is in the desired position.

Figure 24:
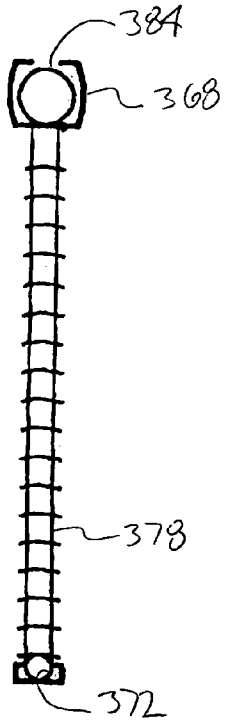
FIG. 24 is a side sectional view of the cordless blind system of FIG. 23.
Figure 23:
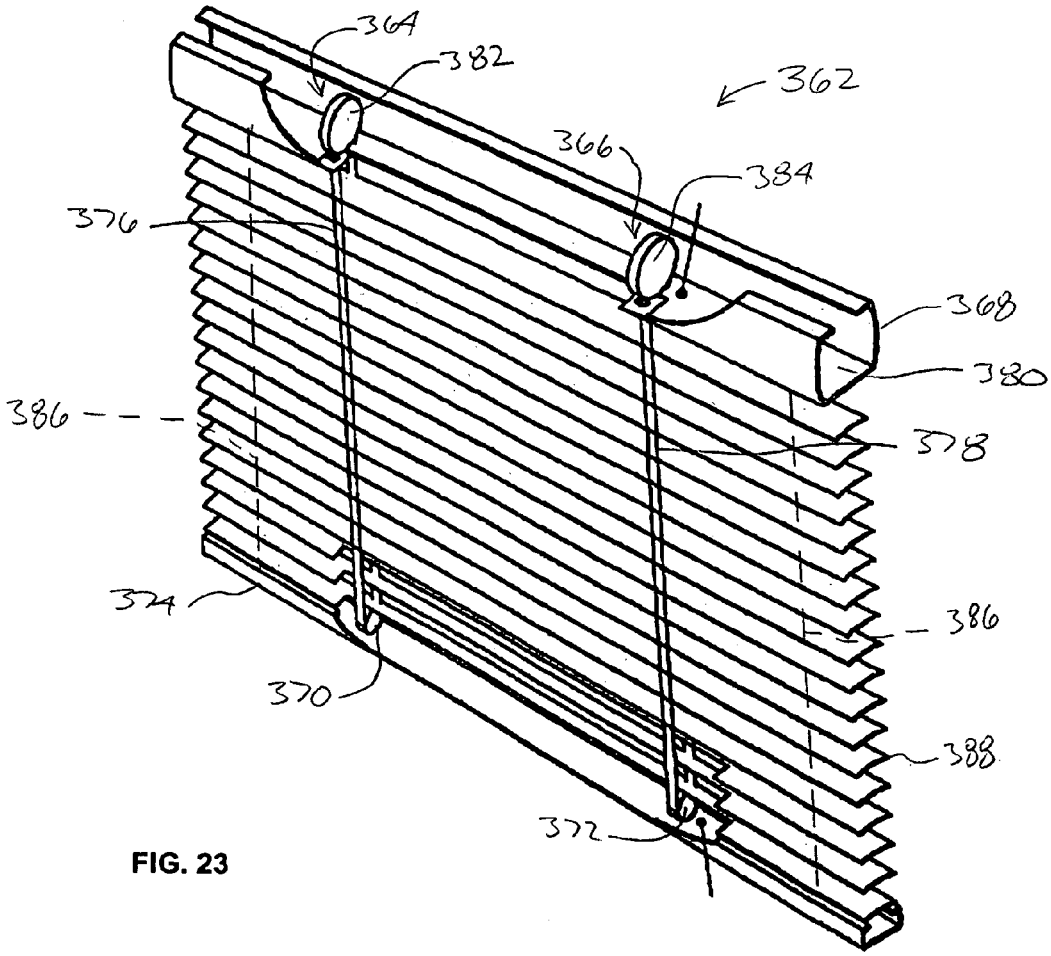
FIG. 23 is a fragmentary perspective view of a cordless blind system according to an alternative embodiment.

FIGS. 23 and 24 disclose a blind 362 that has a drive actuator with a first and second spring motor 364, 366 coupled to a head rail 368, a first and second follower pulley 370, 372 coupled to a bottom rail 374, and a first and second flexible spring member 376, 378. A first spring is attached to a bottom wall 380 of head rail 368, wraps around member 376 first follower pulley 370, and finally winds around a storage drum 382 in first spring motor 364.

First and second follower pulleys 370, 372 provide a constant frictional force that maintains bottom rail 374 in a stationary position. The frictional force from first and second pulleys 370, 372 is overcome by the user lifting or lowering bottom rail 374 of the blind. When bottom rail 374 of the blind is lifted, the first and second spring members 376, 378 wrap around first and second storage drums 382, 384 in the first and second spring motors. Likewise, when the bottom rail is lowered, first and second storage drums 382, 384 rotate, allowing first and second flexible spring members 376, 378 to unwind.

In an exemplary embodiment, first and second spring motors 364, 366 include a constant torque spring that is attached to first and second spool 382, 384. According to a preferred embodiment, a ladder 386 is configured to support the plurality of louvers 388. According to a particularly preferred embodiment, ribbon 386 is translucent or transparent. The ladder is attached to the head rail and is wound on the follower pulleys.

Figure 25:
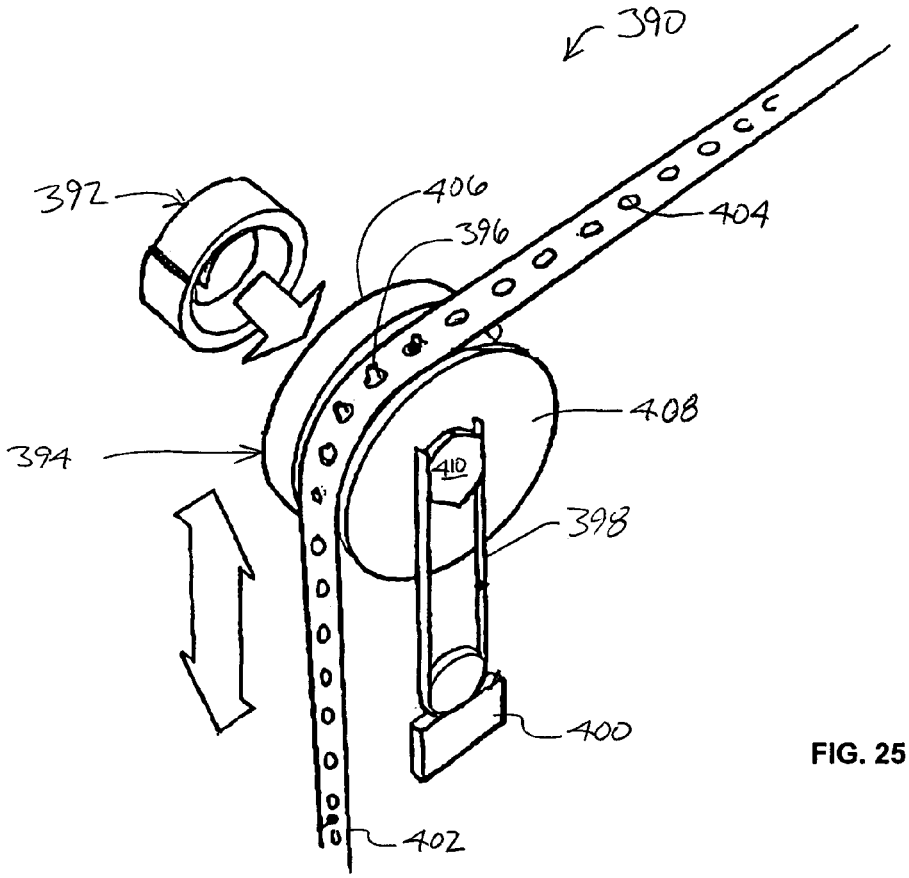
FIG. 25 is a partial exploded perspective view of a counter balance system for a blind.

FIG. 25 discloses a drive actuator 390 for a blind (not shown) configured to provide a counterbalance system. Drive actuator 390 includes a constant torque spring shown as a cord reel type constant torque spring 392, a traction wheel 394, spring steel member 398, an attachment block and mandrel 400, and a relatively stiff strap 402 configured to be pushed and pulled. Traction wheel 394 includes a plurality of cogs 396 that extend out from the circumference of traction wheel 394. Cogs 396 are spaced apart a predetermined distance and fully traction wheel 394. According to an alternative embodiment, cogs 396 partially traction wheel 394. The spacing between cogs 396 corresponds to a plurality of apertures 404 on strap 402.

Traction wheel 394 further includes a first side 406 and a second side 408. Constant torque spring 392 couples to first side 406 of traction wheel 394. A knob 410, preferably multisided, projects from second side 408 of traction wheel 394. Spring steel member 398 is attached to two sides of a multisided knob 410. Block and mandrel 400 are coupled to the spring steel member 398 and configured to freely hang from traction wheel 394.

According to a preferred embodiment, the difference between the starting torque of the brake lock release (not shown) and the constant torque of the spring determines the tension or compression of the strap.

Figure 26:
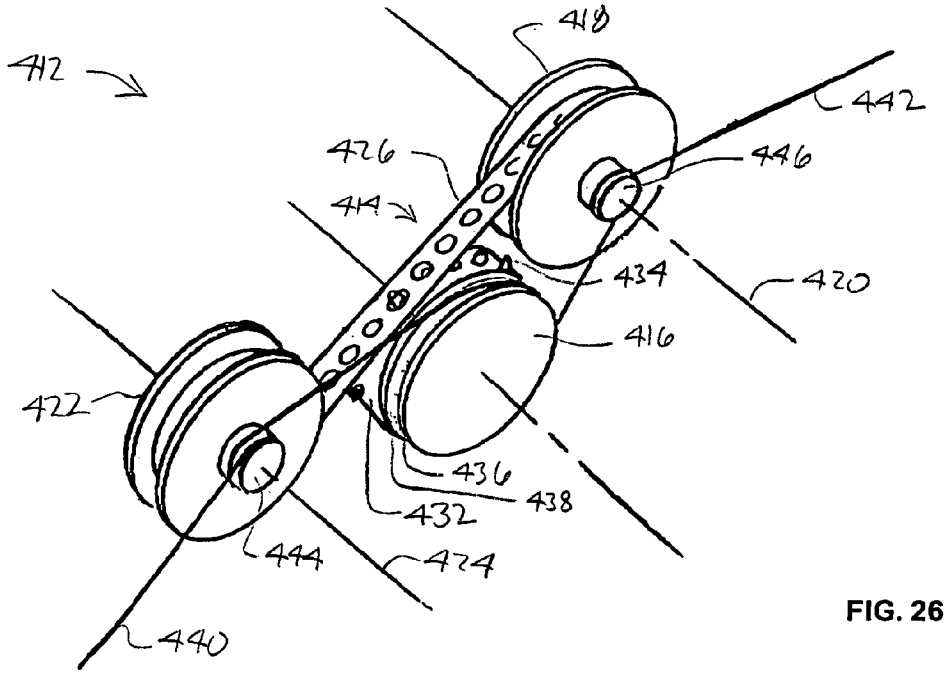
FIG. 26 is a perspective view of a counter balance system for a blind according to an alternative embodiment.

FIG. 26 discloses a cordless system 412 having a drive spring motor 414 and a spool 416. Drive spring motor 414 includes a storage drum 418 having a first axis 420 and an output drum 422 mounted for rotation about a second axis 424 parallel and spaced from the first axis 420. A perforated constant force spring member 426 is coupled and disposed between storage drum 418 and output drum 422 to form spring motor 414. When a bottom rail (not shown) is in a raised position, spring member 426 is tightly wound on storage drum 418. Spool 416 includes a traction surface 432 that circumvents the outside of spool 416. Traction surface 432 includes a plurality of cogs 434 that project from traction surface 432. Cogs 434 engage spring member 426 and rotate spool 416 relative to rotating output drum 420 and storage drum 418. Spool 416 further includes a first and second slot 436, 438 which receive first and second cords 440, 442, respectively.

Cordless system 412 further includes a first and second tensioning pulley 444, 446. First tensioning pulley 444 is connected to output drum 422. First cord 440 is wound on first tensioning pulley 444, preferably at least once, and is wound on spool 416 in first slot 436. Second cord 442 is wrapped around second tensioning pulley 446 and is wound on spool 416 in second slot 438. First and second cord 440, 442 may be attached to either the head rail (not shown) or the bottom rail (not shown). When the bottom rail is raised by the user, which relieves the weight of the bottom rail and the accumulated slats, the spring force overcomes the friction force from first and second tensioning pulleys 444, 446 and the weight of the bottom rail and accumulated slats. As drive spring motor 414 rotate, the perforated constant force spring 426 rotates spool 416 and therefore wind or unwind first and second cords 440, 442.

FIGS. 27 and 28 disclose a drive actuator 448 having a spool (shown as a double slotted take-up reel 450), a spring (shown as a right-hand wound tension spring 452), a first conical section or fusse 454, a spring (shown as a left-hand wound tension spring 456), and a second conical section or fusse 458. Spring 452, double slotted take-up reel 450, and first conical section 454 are mounted on a first axle. Spring 452 and second conical section 458 are mounted on a second axle.

Spool 450 includes a first outer wall 464, a second outer wall 466, and a middle wall 468 disposed between first outer wall 464 and second outer wall 466. First outer wall 464 and middle wall 468 are spaced apart to form a first slot 470 wherein a first cord 472 is wound on spool 450. Second outer wall 466 and middle wall 468 are spaced apart to form a second slot 474 wherein a second cord 476 is wound on spool 450.

Spring 452 is mounted on axle 460 between spool 450 and a first wall 478. Spring 452 applies a tortional force to first axle 460 that would rotate axle 480 in a counterclockwise direction. Spring 456 is coupled to second axle 462 adjacent first wall 478. Spring 456 applies a force to second axle 462 that would rotate axle 462 in a clockwise direction. First and second axles 460, 462 are parallel with each other.

First conical section 454 is mounted on first axle 460 between spool 450 and a second wall 480. First conical section 454 includes a small end 482 and a wide end 484, which has a larger diameter than small end 482. A third cord 486 is attached to first conical section 454 at wide end 484. Second conical section 458 is rotatably coupled to second axle 462.

Second conical section 458 also includes a wide end 488 and a small end 490. Wide end 488 is nearest second wall 480, and small end 490 is nearest first wall 478. In first conical section 454, wide end 488 is nearest first wall 478, and small end 490 is nearest second wall 480. Third cord 486 is attached to the second conical section 458 adjacent wide end 488.

First conical section 454 is placed a short distance from second conical section 458 but in a reversed position, that is, small end 482 of first conical section 454 is opposite wider end 488 of second conical section 458. Thus, wide end 484 of first conical section 454 and smaller end 490 of second conical section 458 are nearest first wall 478, and smaller end 482 of the first conical section 454 and wide end 488 of second conical section 458 are nearest to second wall 480.

As the blind moves upward, the spring force pulling the bottom rail diminishes in strength, but this diminution is compensated for by third cord 486 which gradually passes to smaller end 482 of first conical section 454. When the blind is fully raised and all the slats rest upon the bottom rail, the weight of the blind and the power of the spring will be substantially equal.

Conical sections 454, 458 are configured to compensate for the decreasing spring force by varying the diameter of the winding surface as the bottom rail is raised and lowered. As the bottom rail is raised, the spring force diminishes and the weight on the bottom rail increases. The cordless mechanism uses a connection cord winding and unwinding of a conical spool to make nonlinear energy delivery into a constant force to length ratio. Tension springs are wound in opposite directions, one way to spool in, the other way to spool out.

Figure 29:
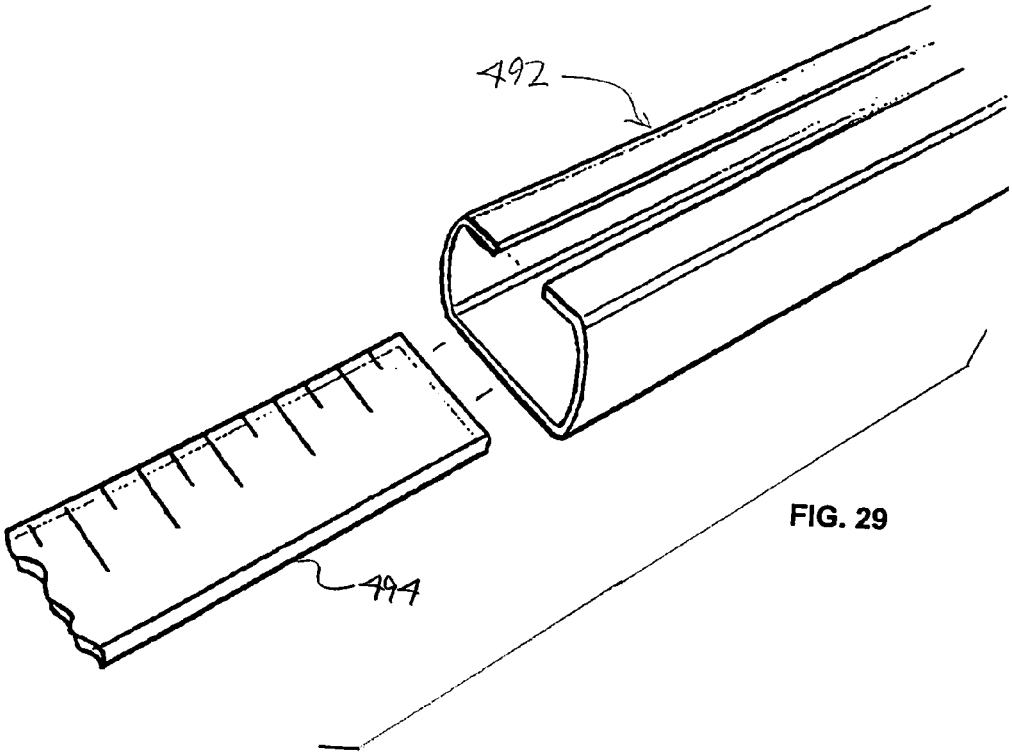
FIG. 29 is a fragmentary exploded view of the device and method for modifying the weight of a bottom rail of a cordless blind according to an alternative embodiment.

FIG. 29 discloses devices and methods for modifying the weight of a bottom rail 492. The weight in bottom rail 492 is selectively modified according to the size of the blind (e.g., after its length is customized at the point of sale), the material that the blind is made out of, and the strength of the spring motor. In order to accommodate for size-in-store modifications to the weight that the spring motor will be required to work with, we could add weight to the bottom bar as the sizes are cut down. According to an exemplary embodiment, "cut-to-length" steel tape 494 is inserted in bottom rail 492 to keep the load on the constant force spring consistent.

Figure 30:
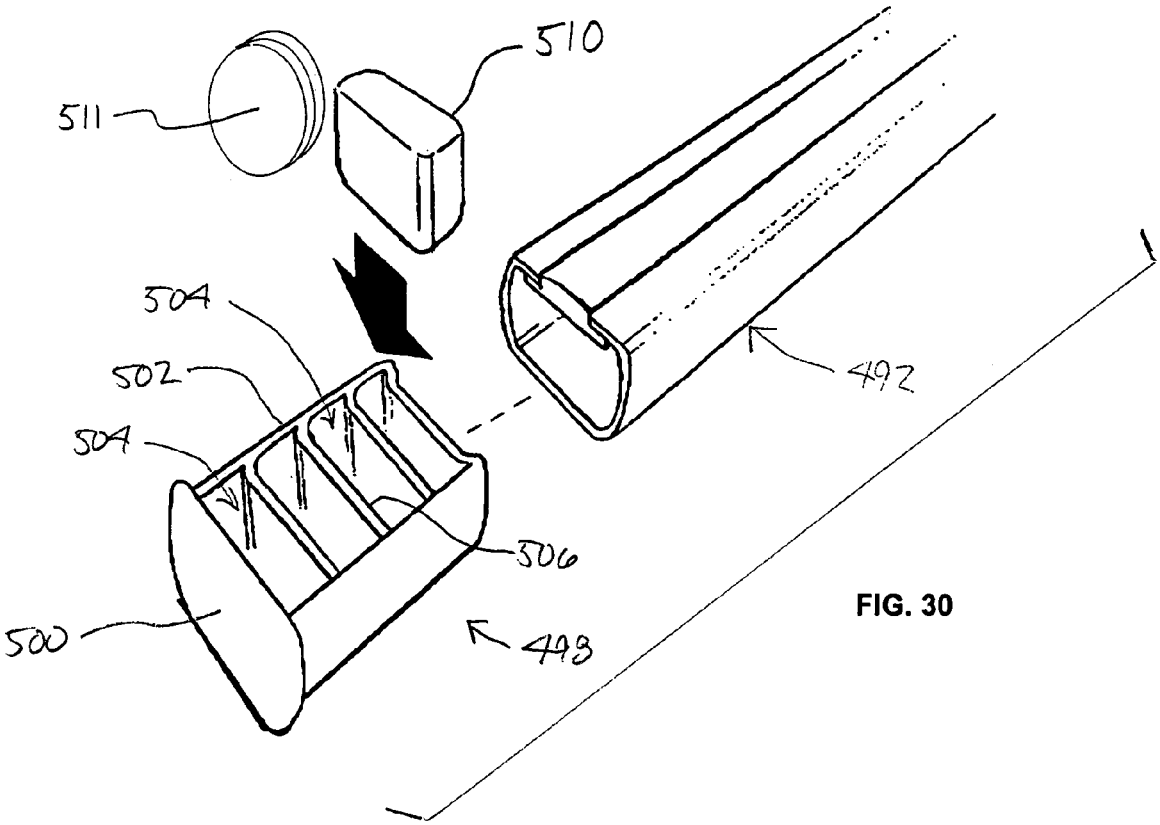
FIG. 30 is a fragmentary exploded view of a device and method for modifying the weight of a bottom rail according to an alternative embodiment.

According to an alternative embodiment shown in FIG. 30, an end plug 498 is configured to be inserted into one end of bottom rail 492. End plug 498 has a capped end 500 and a body 502 that narrows to facilitate insertion into bottom rail 492. Plug 498 is inserted in bottom rail 492 until capped end 500 rests adjacent the end of bottom rail 492. Body 502 of plug 498 includes one or more slots 504 formed by a plurality of walls 506 that extend from opposing side walls 508 of body 502 of plug 498. Slots 504 are configured to receive a weight module 510 (e.g., made from steel, lead, or other generally dense material). According to an alternative embodiment, one or more coins 511 (e.g., penny or the like) may be used as the weight module. Weight module 510 is inserted into slot 504 to compensate for the weight removed by resizing done in the store. According to a preferred embodiment, slots 506 include a retaining system to capture weight module 510. According to a particularly preferred embodiment, walls 506 are made from flexible or compliant material and shaped (e.g., nonlinear, as shown in FIG. 30) so that weight module 510 is held in a secure engagement.

Figure 31:
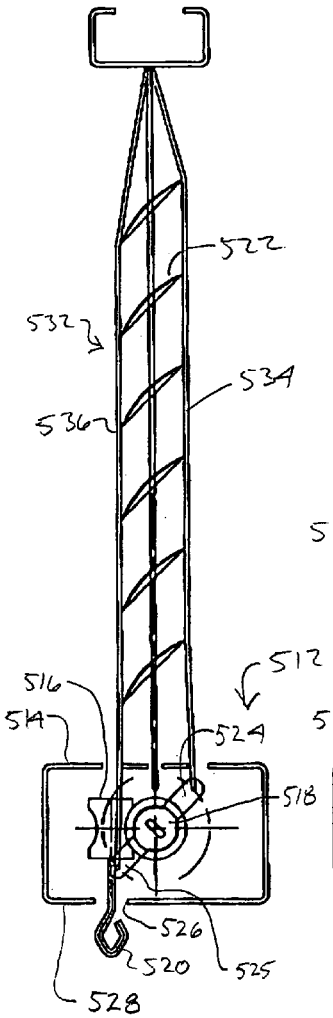
FIG. 31 is a side sectional elevation view of a wandless slat system according to an exemplary embodiment.
Figure 32:
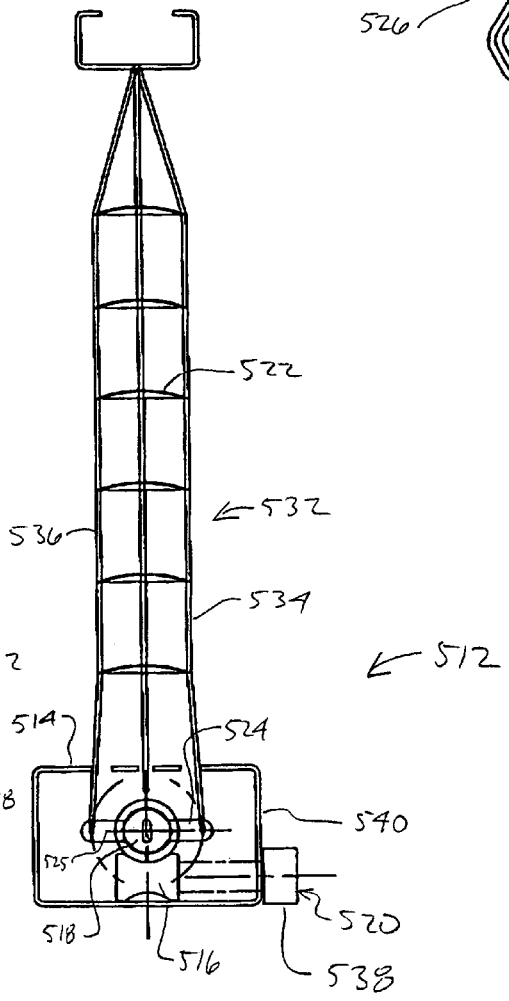
FIG. 32 is a side sectional elevation view of a wandless slat system according to an alternative embodiment.
Figure 33:
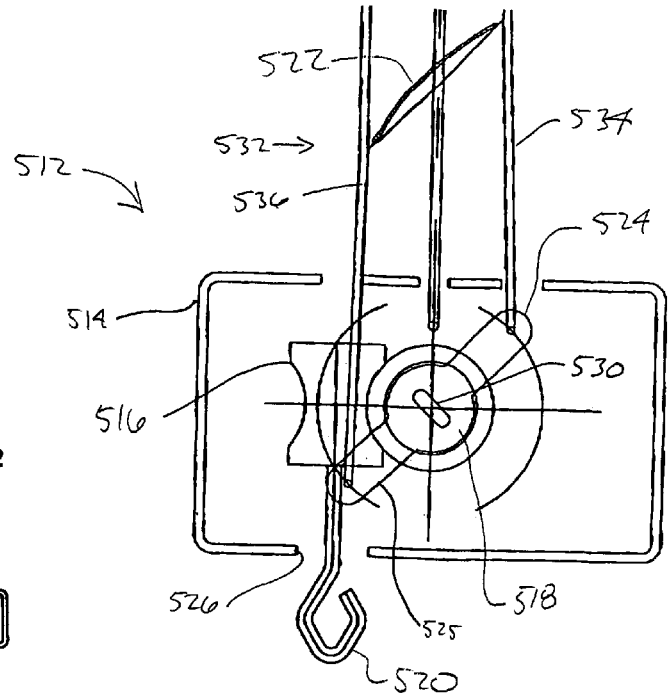
FIG. 33 is a fragmentary side sectional elevation view the system of FIG. 31.

FIGS. 31, 32 and 33 disclose a drive actuator 512 configured for wandless slat adjustment. According to a preferred embodiment, drive actuator 512 is disposed in a bottom rail 514 and includes a slat actuator 516, a first extension member 518, and an actuator interface 520 (shown as a stem in FIGS. 31 and 33, and shown as a knob in FIG. 32). Extension member 518 supports plurality of slats 522 and is connected to a first and second arm 524, 525 of first extension member 518. First extension member 518 is coupled to slat actuator 516. Actuator interface 520 extends through an aperture 526 in a bottom wall 528 of bottom rail 514 and is coupled to slat actuator 516.

As actuator interface 520 is rotated, slat actuator 516 rotates first extension member 518. Slat adjustment system 512 further includes an axle 530 that extends from at least first extension member 518 and a second ladder member (not shown).

A first ladder 532 includes a first and second cord 534, 536. First cord 534 is connected to first arm 524 of first extension member 518, and second cord 536 is connected to second arm 525 of first extension member 518. Similarly, a first cord of the second ladder is connected to a first arm of a second extension member, and a second cord of the second ladder is connected to the second arm of the second extension member (not shown).

As actuator stem 520 is rotated, slat actuator 516 rotates axle 530 such that first extension member 518 and the second ladder member rotate. When first ladder member 518 rotate counterclockwise, first cord 534 of first ladder 532 and the first cord of the second ladder lower relative to second cord 536 of first ladder 532 (and the second cord of the second ladder) such that slats 522 rotate.

Referring to FIG. 32, a knob 538 coupled to slat actuator 516 and extends from a front wall 540 of bottom rail 514. When knob 540 is rotated, slat actuator 516 rotates axle 530. As axle 530 rotates, the first and second ladder members twist and therefore rotating slats 522.

According to an exemplary embodiment, the performance of the blind may be adjusted by a retail sales associate at a retail outlet (e.g., retail sales location such as window covering stores, department stores, discount stores, home improvement stores, etc.). For example, the blind may need to be adjusted if the blind arrives out of adjustment from the factory. Alternatively, the blind may be customized (e.g., cutting to fit a width dimension, cut to length, sized in store, removal of slats or window covering, shortened, etc.) at a point of sale, at the retail outlet by the retail sales associate, or at the installation site by the installer, the consumer, etc. Such customization may alter weight and/or alter the performance characteristics of the blind. Altered weight may have an effect on the performance characteristics of the blind (e.g., the bottom rail does not stay in a desired, static, or "placed position"). After the retail sales associate "customizes" the blind, he/she can adjust the performance or operation of the blind so that the bottom rail may be selectively raised or lowered to a desired position (e.g., height) relative to the head rail and maintain a constant or static position when released. Such adjustment may be any of a variety techniques. According to a preferred embodiment, the retail associate employs any of the techniques disclosed herein and as shown in the FIGURES. For example, weight of the bottom rail may be altered (e.g., added, removed, repositioned, etc.). Alternatively, the bias member (e.g., spring) used in the drive actuator or spring motor may be replaced, exchanged, altered, adjusted, etc. Also, after the blind is installed, the customer or user may further adjust the performance or operation (e.g., fine tune, etc.) by changing the weight in the bottom rail, varying the friction adjusting the biasing force in the drive actuator, etc.

It is important to note that the use of the term "cordless blind" is not meant as a term of limitation, insofar as any "blind" or like apparatus having a decorative or functional use or application as a window covering or furnishing is intended to be within the scope of the term. The use of the term "cordless blind" is intended as a convenient reference for any "blind" or structure that does not have cords (e.g., pull cords) hanging freely for manipulation by the user. It is also important to note that the use of the term "cordless" is meant to cover any use of any type of cord that can be associated with a blind. It is also important to note that the term "window covering" is intended to include any of a variety of blind arrangements, including horizontal or vertical vanes or slats, roller shades, cellular shades, pleated shades, etc.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of preferred embodiments without departing from the spirit of the invention as expressed in the appended claims.

The invention claimed is:

1. A cordless blind comprising:

a headrail;

a bottom rail suspended from the headrail by a first cord and a second cord;

a window covering disposed between the headrail and the bottom rail;

a drive actuator including:

a spring motor, a spool coupled to the spring motor and having a first axis, a first tensioning mechanism having a second axis, and a second tensioning mechanism having a third axis, wherein the first and second tensioning mechanisms are configured to provide a resistant force on movement of the first and second cords, and wherein the first, second and third axes are parallel.

2. The cordless blind of claim 1, wherein the drive actuator is mounted in the headrail.

3. The cordless blind of claim 1, wherein the spring motor includes a storage drum having a fourth axis, an output drum having a fifth axis, and a spring member coupled to the storage drum and the output drum, wherein the fourth and fifth axes are parallel to the first, second and third axes.

4. The cordless blind of claim 1, wherein the spool shares an axis with one of the storage drum and the output drum.

5. The cordless blind of claim 4, wherein the spool includes a first and second slot configured to receive the first and second cords, respectively.

6. The cordless blind of claim 1, wherein the first and second tensioning mechanisms are first and second winding members.

7. The cordless blind of claim 6, wherein the first and second winding members each include a compliant outer surface.

8. The cordless blind of claim 7, wherein the compliant outer surface is an elastomeric material.

9. The cordless blind of claim 7, wherein the first and second cords are wound around the first and second winding members at least once.

10. The cordless blind of claim 1, wherein the first and second tensioning mechanisms each include a tensioning pulley.

11. The cordless blind of claim 1, wherein the first and second tensioning mechanisms each include a wheel.

12. A cordless blind comprising:

a headrail;

a bottom rail suspended from the headrail by a first cord and a second cord;

a window covering disposed between the headrail and the bottom rail;

a drive actuator including:

a spool, a spring motor coupled to the spool, a biasing element coupled to the spring motor and configured to provide a force biased against movement of the bottom rail, wherein the biasing element is a belleville spring; and a bias adjustment mechanism coupled to the biasing element, the bias adjustment mechanism being configured to provide a selective variable application of a biasing force by the biasing element.

13. A cordless blind comprising:

a headrail;

a bottom rail suspended from the headrail by a first cord and a second cord;

a window covering disposed between the headrail and the bottom rail;

a drive actuator including:

a spool, a spring motor coupled to the spool, a biasing element coupled to the spring motor and configured to provide a force biased against movement of the bottom rail;

a bias adjustment mechanism coupled to the biasing element, the bias adjustment mechanism being configured to provide a selective variable application of a basing force by the biasing element, wherein the bias adjustment mechanism is a knob threaded onto an axle and configured to provide variable biasing force upon rotation; and a spacer disposed between the knob and the biasing element, wherein rotation of the knob forces the spacer against the spring.

14. A blind comprising:

a headrail;

a bottom rail suspended from the headrail;

a window covering disposed between the headrail and the bottom rail;

a spring motor being adapted to apply a force to the bottom rail in the direction of the headrail; and means for applying a varying amount of weight to the bottom rail to counterbalance the force of the spring motor, the amount of weight applied to the bottom rail being adapted to maintain the bottom rail in a given position with respect to the headrail, wherein the means for applying the varying amount of weight to the bottom rail includes an end plug configured to be inserted in an end of the bottom rail, the end plug includes a capped end and a body which narrows to facilitate insertion into the bottom rail, and wherein the body of the end plug includes a one or more slots defined by a plurality of walls, the slot receiving a weight module.

15. The blind of claim 14, wherein the weight module is one of steel and lead.

16. The blind of claim 14, wherein the slots include a compliant retaining system configured to capture weight module in a secure engagement.

17. The blind of claim 16, wherein the compliant retaining system include walls are made from a compliant material and shaped so that the weight module is held securely by the one or more slots.

* * * * *